US009604780B2

(12) United States Patent
Warren

(10) Patent No.: US 9,604,780 B2
(45) **Date of Patent: *Mar. 28, 2017**

(54) INFLATABLE REFUSE CONTAINERS AND METHODS OF USE

(71) Applicant: William J. Warren, Frisco, TX (US)

(72) Inventor: William J. Warren, Frisco, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/876,758

(22) Filed: Oct. 6, 2015

(65) Prior Publication Data

US 2016/0023845 A1 Jan. 28, 2016

Related U.S. Application Data

(63) Continuation of application No. 14/281,175, filed on May 19, 2014, now Pat. No. 9,199,790.

(60) Provisional application No. 61/855,695, filed on May 21, 2013.

(51) Int. Cl.
*B65F 1/14* (2006.01)
*B65F 1/02* (2006.01)

(52) U.S. Cl.
CPC ..... *B65F 1/141* (2013.01); *B65F 1/02* (2013.01); *B65F 2210/1023* (2013.01); *B65F 2210/132* (2013.01); *B65F 2220/116* (2013.01)

(58) Field of Classification Search
CPC .... B65B 67/12; B65D 81/052; B65D 81/051; B65D 81/05; B65F 1/1415; B65F 1/141; B65F 1/14; B65F 1/0046; B65F 1/004; B65F 1/0033; B65F 1/02
USPC ..... 220/9.4, 4.28, 908, 530, 529; 383/3
See application file for complete search history.

(56) References Cited

U.S. PATENT DOCUMENTS

| | | | |
|---|---|---|---|
| 2,587,033 | A | 2/1952 | Dobbs et al. |
| 2,751,953 | A | 6/1956 | Grimm |
| 3,000,185 | A | 9/1961 | Brinkmann, Jr. |
| 3,044,515 | A | 7/1962 | Eades |
| 3,186,543 | A | 6/1965 | Minick |
| 3,204,866 | A | 9/1965 | Brighton et al. |
| 3,294,223 | A | 12/1966 | Goban |
| 3,556,186 | A | 1/1971 | Besthorne et al. |
| 3,742,994 | A | 7/1973 | Pensak |
| 4,000,585 | A | 1/1977 | Denaro |
| 4,044,867 | A | 8/1977 | Fisher |
| 4,091,852 | A | 5/1978 | Jordan et al. |
| 4,103,810 | A | 8/1978 | Hickey |

(Continued)

FOREIGN PATENT DOCUMENTS

| | | |
|---|---|---|
| EP | 374360 | 6/1990 |
| GB | 2314004 | 12/1997 |

(Continued)

OTHER PUBLICATIONS

Office Action, Jan. 20, 2015, U.S. Appl. No. 14/275,907, filed May 13, 2014.

(Continued)

*Primary Examiner* — Robert J Hicks
(74) *Attorney, Agent, or Firm* — Carr & Ferrell LLP

(57) ABSTRACT

A trash container for holding waste is provided. An example trash container can include an inflatable frame, a front flexible wall connected to the inflatable frame, and a back flexible wall that is connected to the inflatable frame and opposed to the front flexible wall. The trash container can further include a pair of side flexible walls connected to the inflatable frame and also connected to both the front flexible wall and the back flexible wall.

20 Claims, 31 Drawing Sheets

(56) References Cited

U.S. PATENT DOCUMENTS

| | | | |
|---|---|---|---|
| 4,375,809 | A | 3/1983 | Meals |
| 4,384,603 | A | 5/1983 | Tyrer et al. |
| 4,612,781 | A | 9/1986 | Swerdon |
| 4,809,352 | A | 2/1989 | Walker |
| 4,858,755 | A | 8/1989 | Kuivanen |
| 4,867,576 | A | 9/1989 | Boyd |
| 4,919,290 | A | 4/1990 | Wadel |
| 4,941,754 | A | 7/1990 | Murdock |
| 5,127,523 | A | 7/1992 | Herdlicka |
| 5,209,364 | A | 5/1993 | LaPoint, Jr. |
| 5,314,250 | A | 5/1994 | Lee |
| 5,692,833 | A | 12/1997 | DeLuca |
| 5,735,495 | A | 4/1998 | Kubota |
| 6,123,217 | A | 9/2000 | Miller |
| 6,606,880 | B1 | 8/2003 | Carlin et al. |
| 7,972,063 | B1 | 7/2011 | Barsalou |
| 9,199,790 | B2 | 12/2015 | Warren |
| 9,248,962 | B2 | 2/2016 | Warren |
| 9,248,963 | B2 | 2/2016 | Warren |
| 2005/0066562 | A1 | 3/2005 | Bober et al. |
| 2006/0207849 | A1 | 9/2006 | Sadow |
| 2010/0303387 | A1 | 12/2010 | Dahlquist |
| 2015/0021333 | A1 | 1/2015 | Warren |
| 2015/0023613 | A1 | 1/2015 | Warren |
| 2015/0076145 | A1 | 3/2015 | Warren |
| 2016/0137409 | A1 | 5/2016 | Warren |
| 2016/0137410 | A1 | 5/2016 | Warren |

FOREIGN PATENT DOCUMENTS

| | | |
|---|---|---|
| WO | WO 9501294 | 1/1995 |
| WO | WO 2015156959 | 10/2015 |

OTHER PUBLICATIONS

Final Office Action, Apr. 28, 2015, U.S. Appl. No. 14/275,907, filed May 13, 2014.

Advisory Action, Jul. 30, 2015, U.S. Appl. No. 14/275,907, filed May 13, 2014.

Advisory Action, Sep. 1, 2015, U.S. Appl. No. 14/275,907, filed May 13, 2014.

Office Action, Mar. 11, 2015, U.S. Appl. No. 14/287,133, filed May 26, 2014.

Office Action, Mar. 3, 2015, U.S. Appl. No. 14/281,175, filed May 19, 2014.

Notice of Allowance, Jun. 22, 2015, U.S. Appl. No. 14/281,175, filed May 19, 2014.

Supplemental Notice of Alliwability, Oct. 21, 2015, U.S. Appl. No. 14/281,175, filed May 19, 2014.

Notice of Allowance, Sep. 16, 2015, U.S. Appl. No. 14/287,133, filed May 26, 2014.

Ex Parte Quayle Action, Sep. 29, 2015, U.S. Appl. No. 14/275,907, filed May 13, 2014.

Notice of Allowance, Nov. 5, 2015, U.S. Appl. No. 14/275,907, filed May 13, 2014.

Translation of EP 374360 (Achterberg et al.), Jun. 27, 1990, pp. 3 and 8.

INFLATABLE REFUSE CONTAINERS AND METHODS OF USE

CROSS-REFERENCE TO RELATED APPLICATIONS

The present application is a continuation of U.S. patent application Ser. No. 14/281,175, filed on May 19, 2014 (issued on Dec. 1, 2015 as U.S. Pat. No. 9,199,790), which claims the benefit of U.S. Provisional Application No. 61/855,695, filed on May 21, 2013, both of which are herein incorporated by reference in their entirety.

FIELD

The present technology relates to trash containers and, more particularly, to a trash container having flexible walls.

BACKGROUND

Trash is a common problem around the home, office and outdoors. In order to collect this trash, trash cans have been used. However, these trash cans can be small and generally have rigid sidewalls. The rigid sidewalls prevent the trash cans from being flattened out and stored in a relatively small space. What is needed is a trash can which can be easily deployed and easily stored in a limited space.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

According to various embodiments of the described technology, a trash container for holding waste is provided. An example trash container can include an inflatable frame, a front flexible wall connected to the inflatable frame, and a back flexible wall that is connected to the inflatable frame and opposed to the front flexible wall. The trash container can further include a pair of side flexible walls connected to the inflatable frame and also connected to both the front flexible wall and the back flexible wall.

In various embodiments, the trash container can include a rigid bottom wall. Other embodiments of the trash container can include a tie down strap.

In some embodiments, the trash container can include an inflator/deflator device including a valve to inflate and deflate the frame of the trash container. In further embodiments, the trash container can include a release valve.

In some embodiments, the trash container can include a cleat.

In further embodiments, the bottom wall may be inclined at an angle between 1° and 90° with respect to a support surface. A bench support system may be placed under the inclined wall for a pet.

BRIEF DESCRIPTION OF THE DRAWINGS

The technology may be understood by reference to the following description taken in conjunction with the accompanying drawings, in which, like reference numerals identify like elements, and in which.

DETAILED DESCRIPTION

Figure 1:
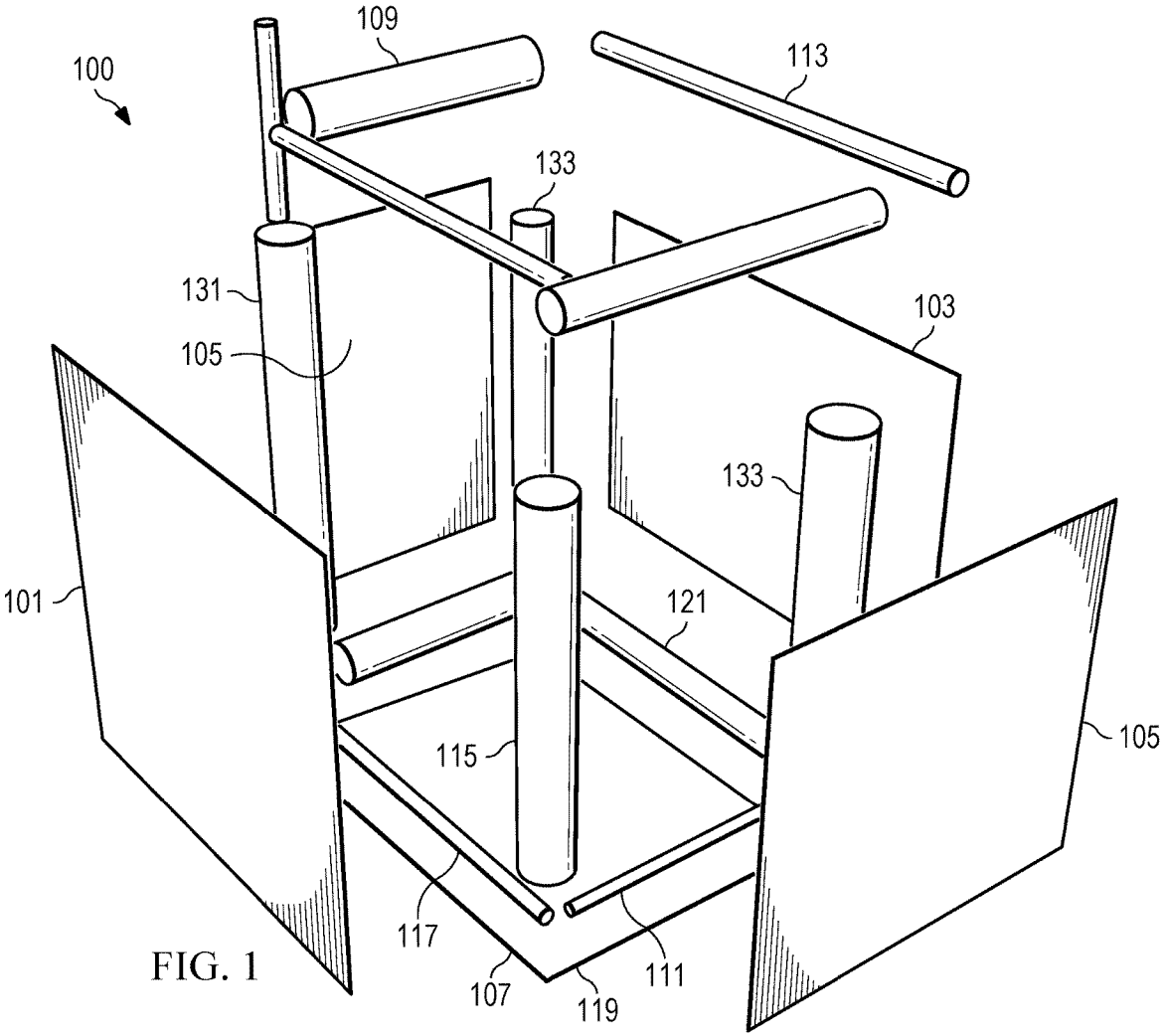
FIG. 1 illustrates an exploded view of the trash container of the present technology, according to an example embodiment.

FIG. 1 illustrates a trash container 100 which may include a front flexible wall 101, a back flexible wall 103, and a pair of side flexible walls. The front flexible wall 101, the back flexible wall 103 and the pair of side flexible walls 105 may be formed from a flexible sheet, which may be a plastic, such as HEFTY, GLAD, or a similar type of material, cloth, a balloon type substance, a woven material polyvinyl material or any other material available. The front flexible wall 101, the back flexible wall 103 and the pair of side flexible walls 105 may be connected to a bottom wall 107 which may be flexible or rigid.

The front flexible wall 101 may be opposed to the back flexible wall 103 and may be connected to the pair of side flexible walls 105, and the back flexible wall may be opposed to the front flexible wall 101 and may be connected to the pair of opposing side walls 105.

The first flexible wall 101, the back flexible wall 103, the pair of side flexible walls 105 and the bottom wall 107 may be connected to a frame 109 which may include a bottom periphery member 111, an opposed top periphery member 113 and a substantially vertical member 115 to connect the bottom periphery member 111 to the top periphery member 113.

The bottom periphery member 111, the top periphery member 113 and the vertical member 115 may be a hollow expandable tube or multiple tubes which may be expanded by fluid pressure such as air and may be returned to the original position (which may be deflated) by the release of the fluid pressure such as air, and each member may be interconnected with at least one other member in order to allow the fluid to flow and pressurize each member simultaneously.

FIG. 1 shows the bottom periphery member 111, the top periphery member 113 and the vertical member 115 which may be optionally a cylinder having a circular cross-section or other appropriate shape.

The bottom periphery member 111 may include a front bottom frame member 117 which may be connected to a side bottom frame member 119 and which may be connected to a first vertical frame member 129 and a second vertical frame member 131 and a back bottom frame member 121 which may be connected to the side bottom frame member 119 and which may be connected to a third vertical frame member 133 and a fourth vertical frame member 138.

Figure 2:
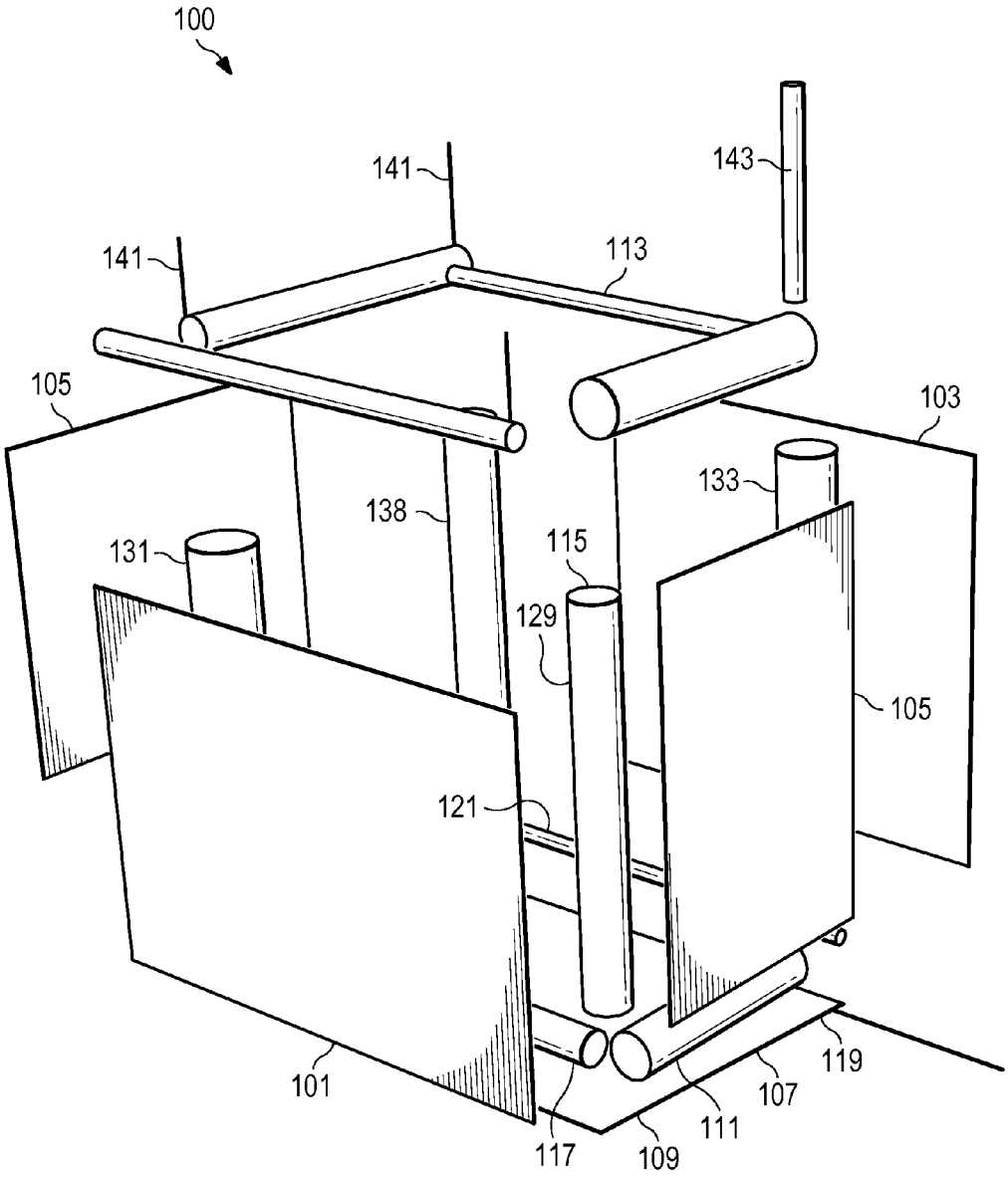
FIG. 2 illustrates an exploded view of the trash container of the present technology, according to an example embodiment.

FIG. 2 illustrates a trash container 100 which may include a front flexible wall 101, a back flexible wall 103, and a pair of side flexible walls. The front flexible wall 101, the back flexible wall 103 and the pair of side flexible walls 105 may be formed from a flexible sheet, which may be a plastic, such as HEFTY, GLAD, or a similar type of material, cloth, a balloon type substance, a woven material polyvinyl material or any material. The front flexible wall 101, the back flexible wall 103 and the pair of side flexible walls 105 may be connected to a bottom wall 107 which may be flexible or rigid.

The front flexible wall 101 may be opposed to the back flexible wall 103 and may be connected to the pair of side flexible walls 105, and the back flexible wall may be opposed to the front flexible wall 101 and may be connected to the pair of opposing side walls 105.

The first flexible wall 101, the back flexible wall 103, the pair of side flexible walls 105 and the bottom wall 107 may be connected to a frame 109 which may include a bottom periphery member 111, an opposed top periphery member 113 and a substantially vertical member 115 to connect the bottom periphery member 111 to the top periphery member 113.

The bottom periphery member 111, the top periphery member 113 and the vertical member 115 may be an hollow expandable tube or multiple tubes which may be expanded by fluid pressure such as air and may be returned to the original position (which may be deflated) by the release of the fluid pressure such as air, and each member may be interconnected with at least one other member in order to allow the fluid to flow and pressurize each member simultaneously.

FIG. 2 shows the bottom periphery member 111, the top periphery member 113 and the vertical member 115 being optionally a cylinder having a circular cross-section or another appropriate shape.

The bottom periphery member 111 may include a front bottom frame member 117 which may be connected to a side bottom frame member 119 and which may be connected to a first vertical frame member 129 and a second vertical frame member 131 and a back bottom frame member 121 which may be connected to the side bottom frame member 119 and which may be connected to a third vertical frame member 133 and a fourth vertical frame member 135.

FIG. 2 additionally illustrates tied down straps 141 to be used to tie down the trash container 100, and FIG. 2 illustrates an inflation/deflation device 143 to allow the frame 109 to be inflated or deflated which may include an adjustable valve to seal an unseal the frame 109.

Figure 3:
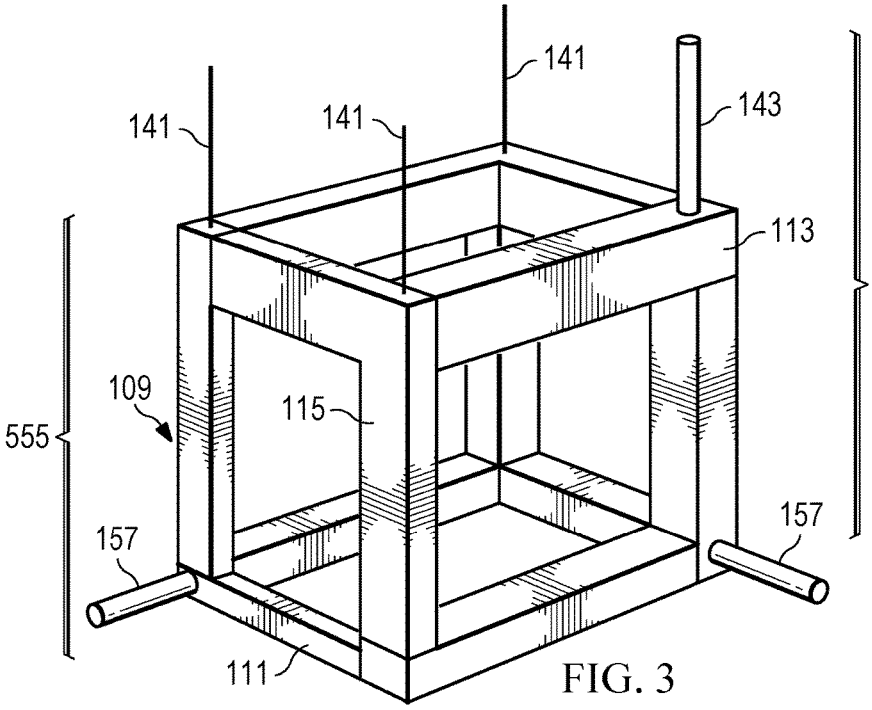
FIG. 3 illustrates a perspective view of the frame of the trash container of the present technology, according to an example embodiment.

FIG. 3 illustrates a frame 109 of an exemplary trash container 555. The frame 109 may be formed from a bottom periphery member 111, a top periphery member 113 and a vertical member 115 which may be rectangular in cross-section. The first flexible wall 101, the back flexible wall 103, the pair of side flexible walls 105 and the bottom wall 107 (not shown) may be connected to a frame 109.

Figure 4:
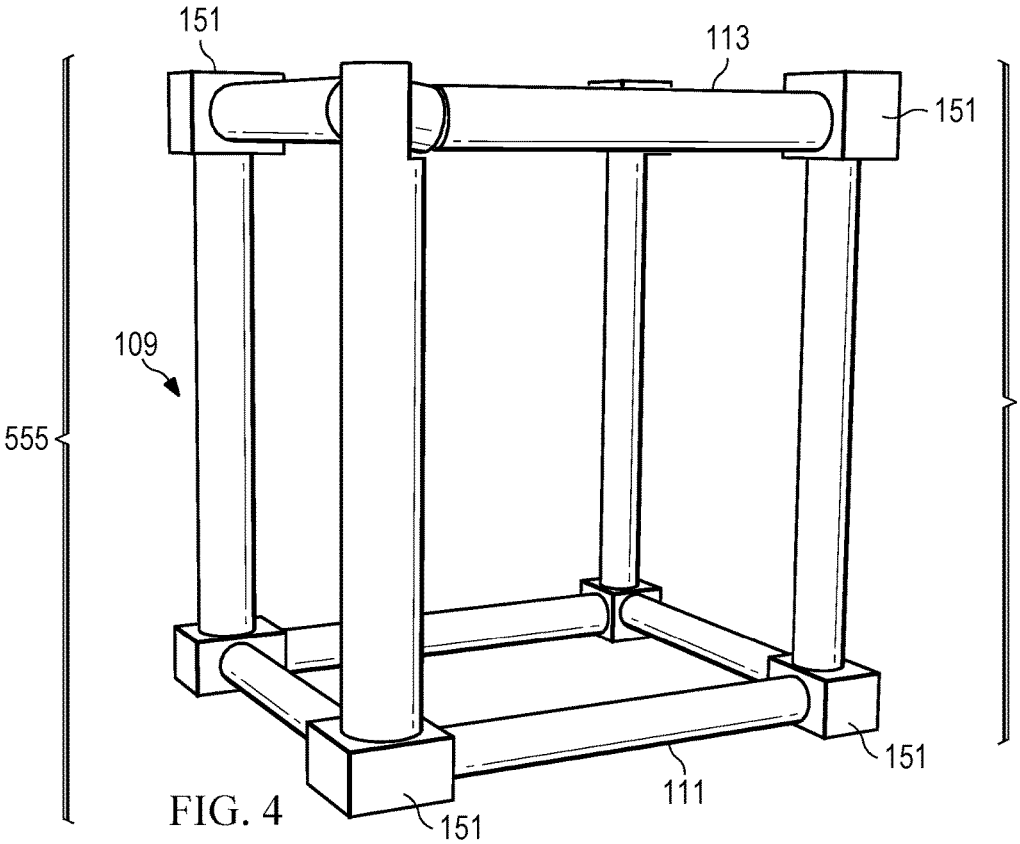
FIG. 4 illustrates a perspective view of the frame of the trash container of the present technology, according to an example embodiment.

FIG. 4 illustrates a frame 109 of an exemplary trash container 555. The frame 109 may include the bottom periphery member 111, the top periphery member 113 and the vertical member 115 which may be cylinders and which may be connected by a rectangular member 151.

Figure 5:
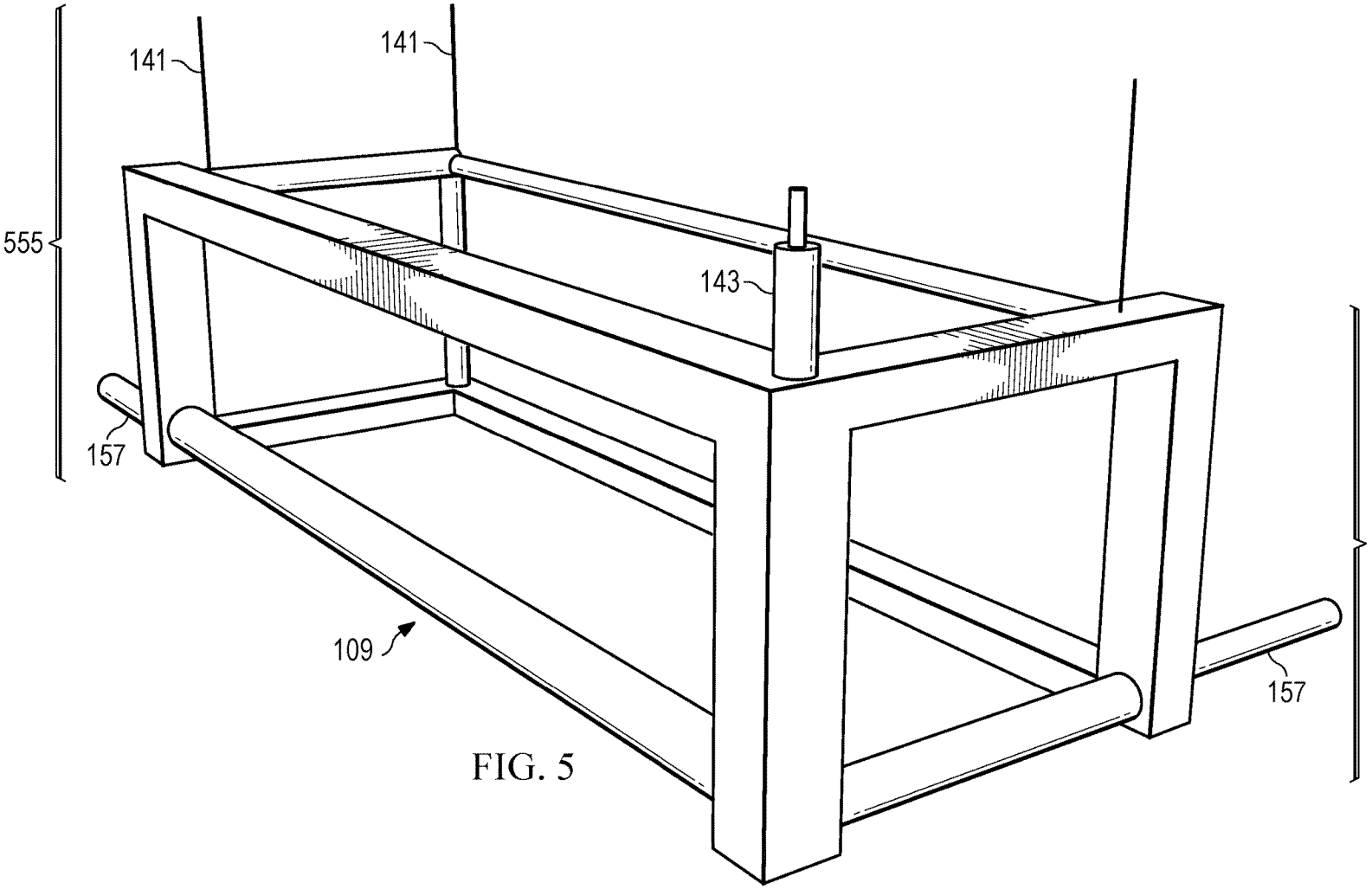
FIG. 5 illustrates a perspective view of the frame of the trash container of the present technology, according to an example embodiment.

FIG. 5 illustrates a frame 109 of an exemplary trash container 555. The frame 109 may include the bottom periphery member 111 which may include cylinder and rectangular portions, the top periphery member 113 which may include cylinder and rectangular (where any other shape) portions and the vertical member 115 which may include cylinder and rectangular portions. The frame 109 may include a multitude of release valves 157.

Figure 6:
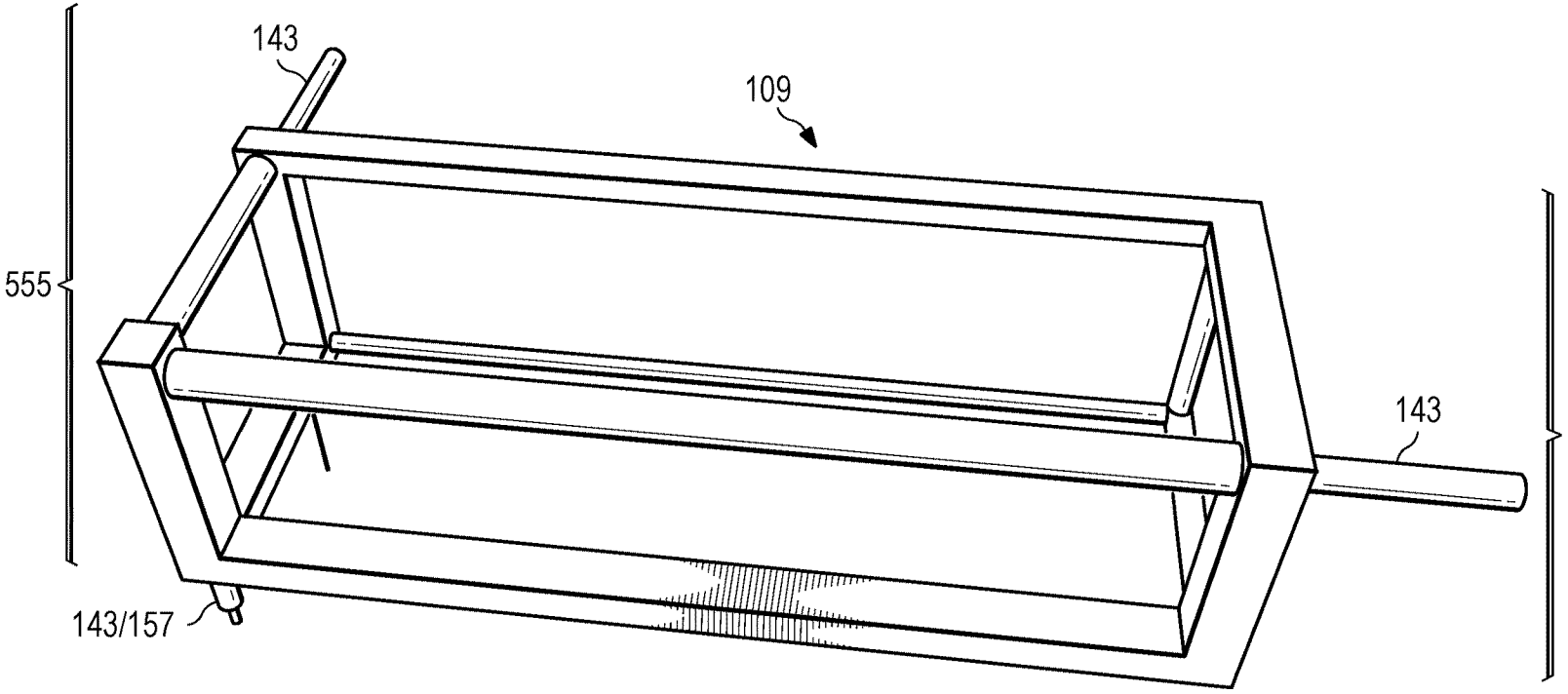
FIG. 6 illustrates a perspective view of the frame of the trash container of the present technology, according to an example embodiment.

FIG. 6 illustrates the frame 109 of the exemplary trash container 555 of FIG. 5 from a different angle.

The first flexible wall 101, the back flexible wall 103, the pair of side flexible walls 105 and the bottom wall 107 (not shown) may be connected to a frame 109. FIG. 6 illustrates different shapes combinations.

Figure 7:
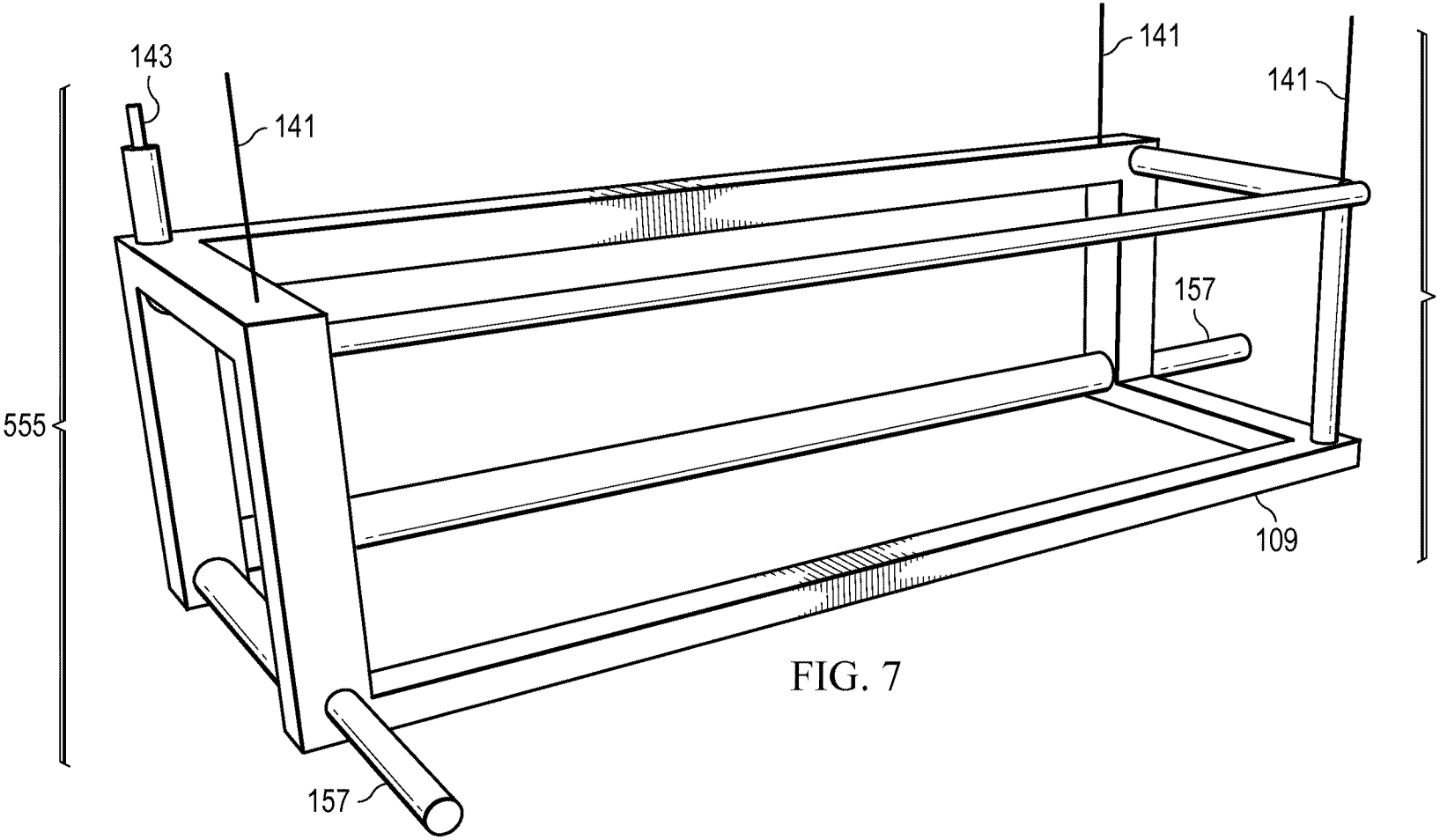
FIG. 7 illustrates a perspective view of the frame of the trash container of the present technology, according to an example embodiment.

FIG. 7 illustrates the frame 109 of the exemplary trash container 555 of FIG. 5 from a different angle.

The first flexible wall 101, the back flexible wall 103, the pair of side flexible walls 105 and the bottom wall 107 (not shown) may be connected to a frame 109. The present technology may include multiple inflator/deflator devices 143 for blowup and deflation. The frame 109 may be any appropriate size or shape. Element 157 is a quick deflator.

Figure 8:
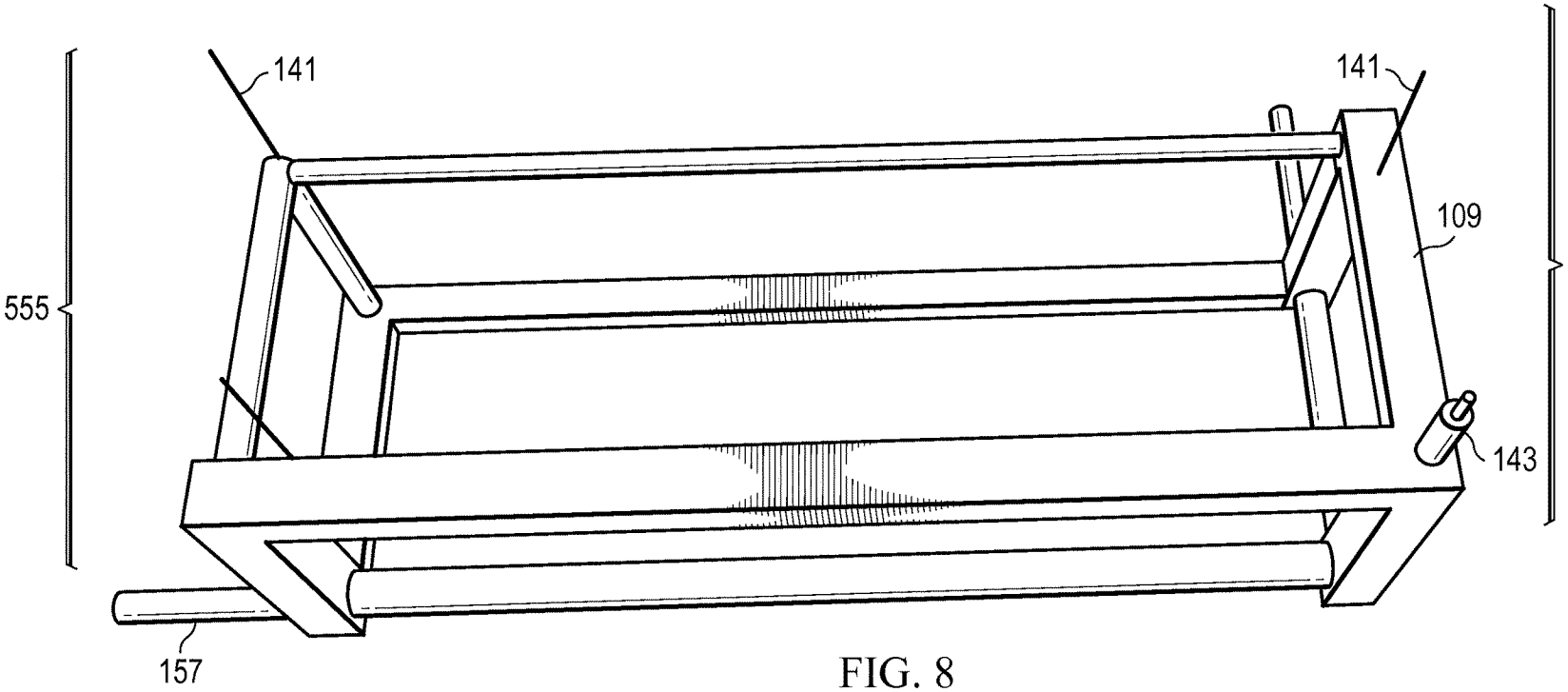
FIG. 8 illustrates a perspective view of the frame of the trash container of the present technology, according to an example embodiment.

FIG. 8 illustrates the frame 109 of the exemplary trash container 555 of FIG. 5 from a different angle.

The frame 109 may be any appropriate size or shape.

The first flexible wall 101, the back flexible wall 103, the pair of side flexible walls 105 and the bottom wall 107 (not shown) may be connected to a frame 109.

Figure 9:
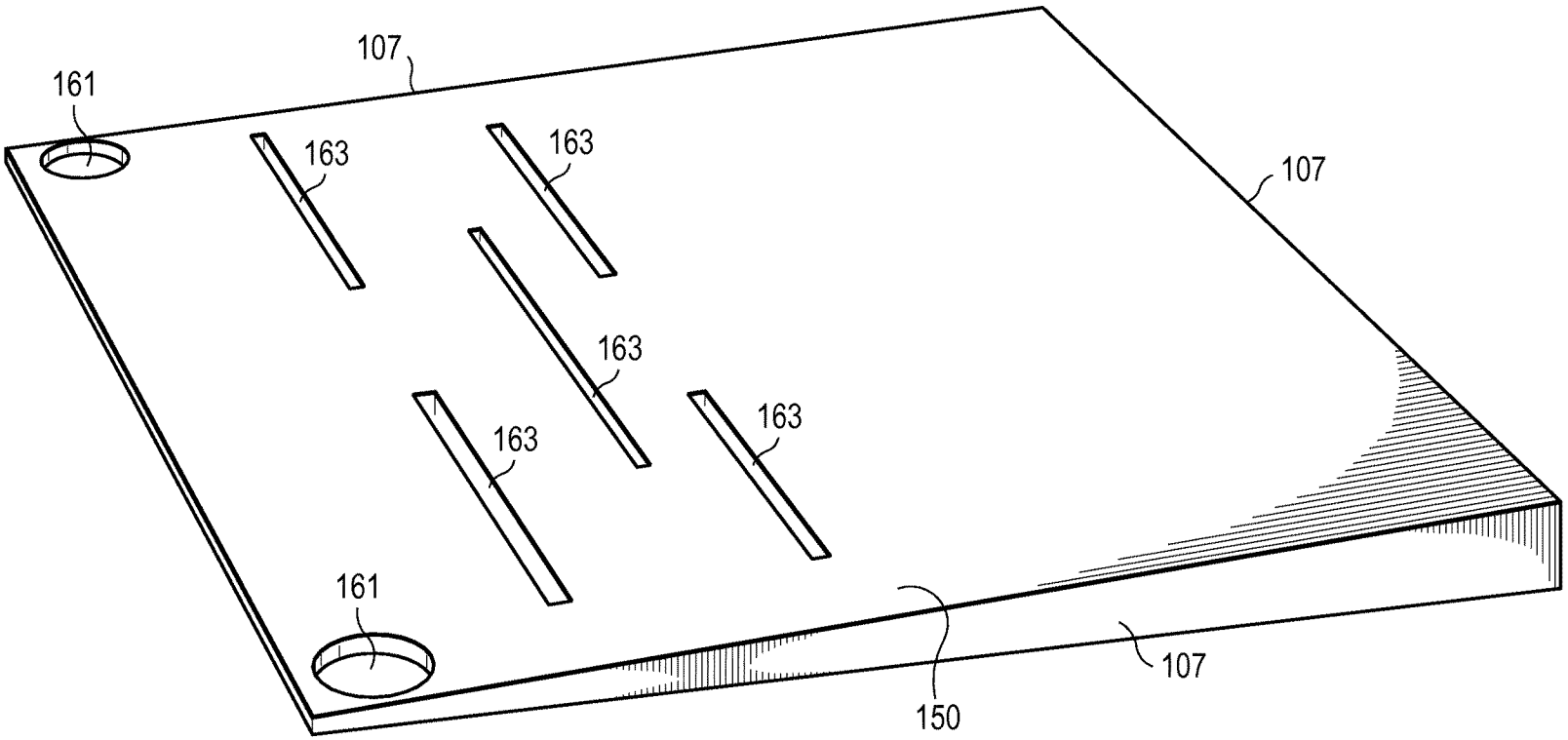
FIG. 9 illustrates a perspective view of the bottom wall of the trash container of the present technology, according to an example embodiment.

FIG. 9 illustrates the bottom wall 107 of the frame 109 which may be substantially flat or may be inclined (as illustrated) to allow any liquids which has been placed into the trash container 101 to flow to the lowest level of the bottom wall 107 and out of the trash container. The bottom wall 107 may include a multitude of slits 163 and may include an aperture 161 which may cooperate with the vertical member 115. FIG. 9 additionally illustrates a mat 150 which may be absorbing or non-absorbing to prevent liquids from escaping from the frame 109 on to the support surface.

Figure 10:
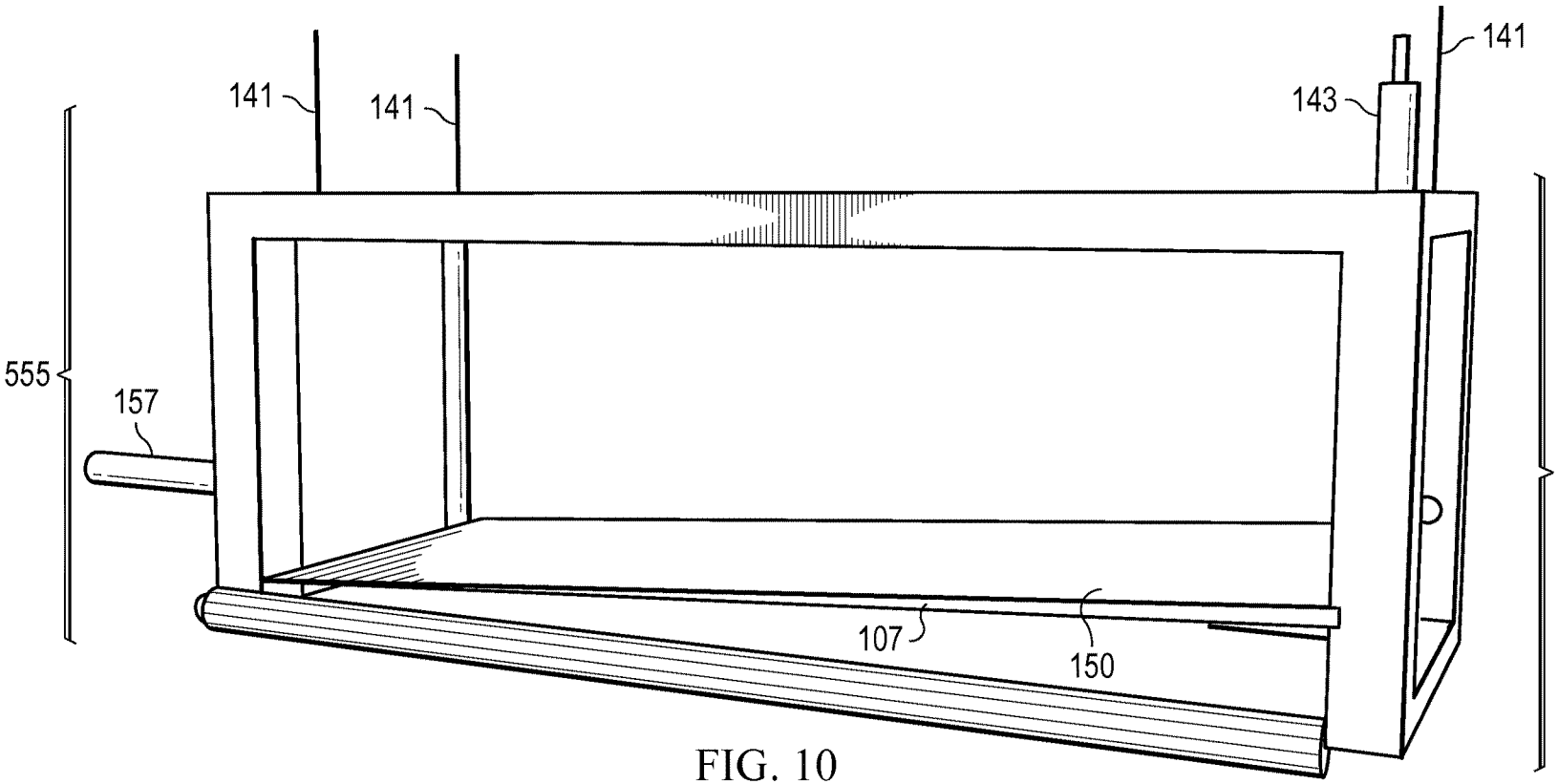
FIG. 10 illustrates a perspective view of the frame of the trash container of the present technology, according to an example embodiment.

FIG. 10 illustrates a perspective view of a frame 109 of an exemplary trash container 555. The frame 109 may include an inclined bottom wall 107, a multitude of tie down straps 141, an inflator/deflator device 143 and a release valve 157. FIG. 10 additionally illustrates a mat 150 which may be absorbing or non-absorbing to prevent liquids from escaping from the frame 109 on to the support surface. The mat 150 may be positioned between the bottom wall 107 and the bottom layer. The tied down straps may be used to gather the container together in order to conveniently dispose of the contents of the container.

Figure 11:
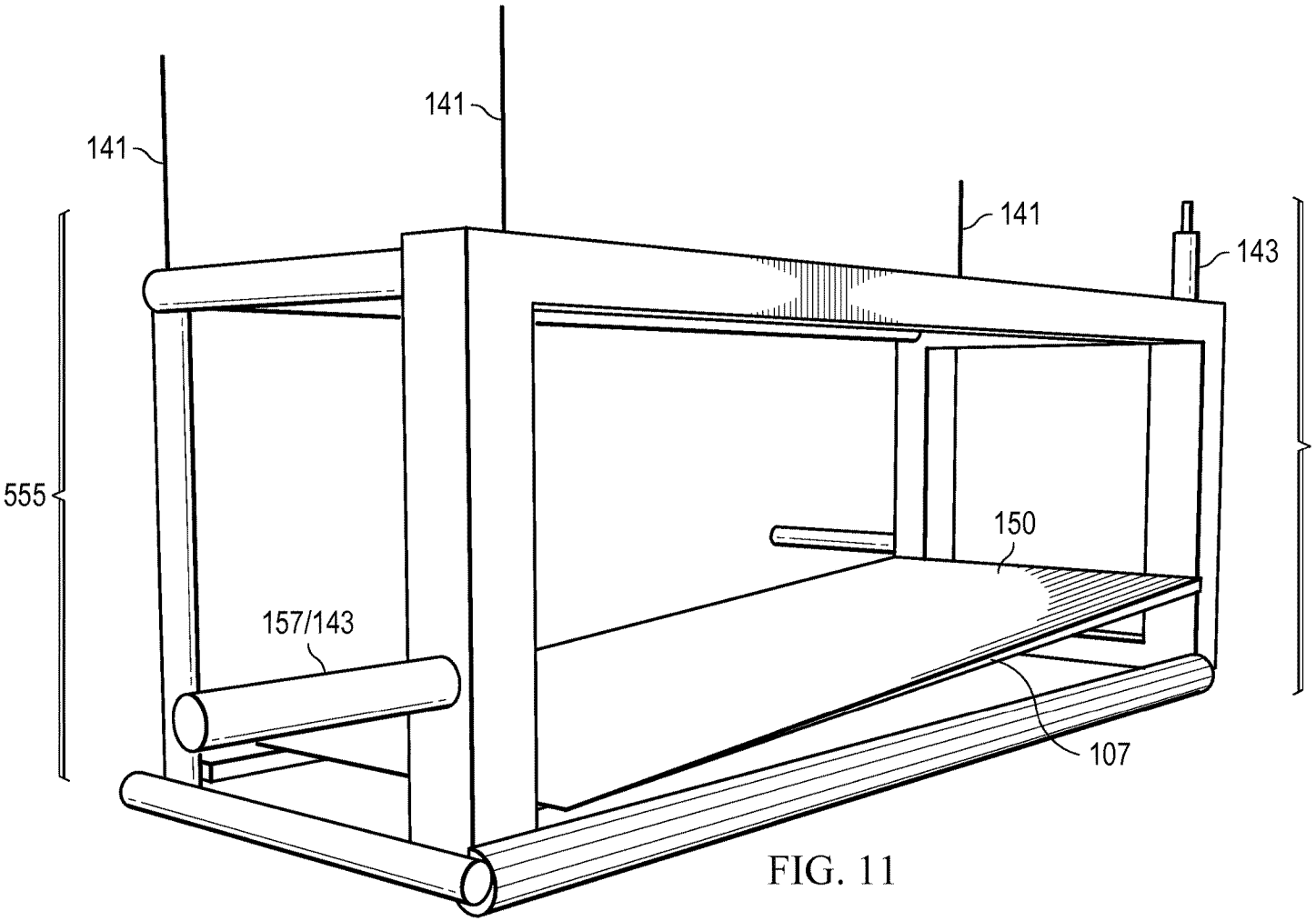
FIG. 11 illustrates a perspective view of the frame of the trash container of the present technology, according to an example embodiment.

FIG. 11 illustrates a perspective view of a frame 109 of an exemplary trash container 555. The frame 109 may include an inclined bottom wall 107, a multitude of tied down straps 141, an inflator/deflator device 143 and a release valve 157.

Figure 11A:
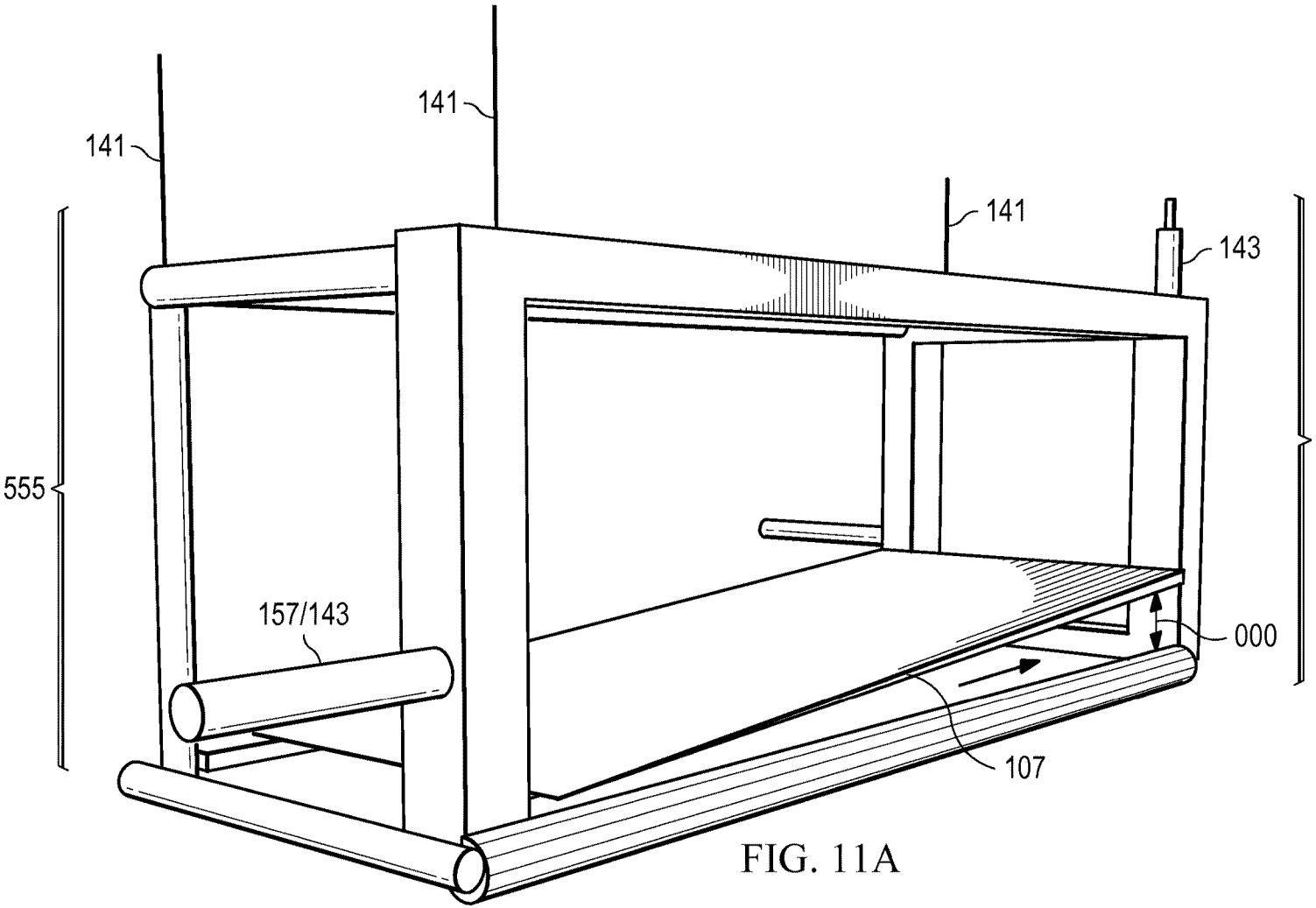
FIG. 11A illustrates a perspective view of the frame of the trash container of the present technology, according to an example embodiment.

FIG. 11A illustrates an absorption system of an exemplary trash container 555. The absorption system may be positioned within the cavity 000 and which may be positioned under the rigid or non-rigid bottom wall 107.

Figure 12:
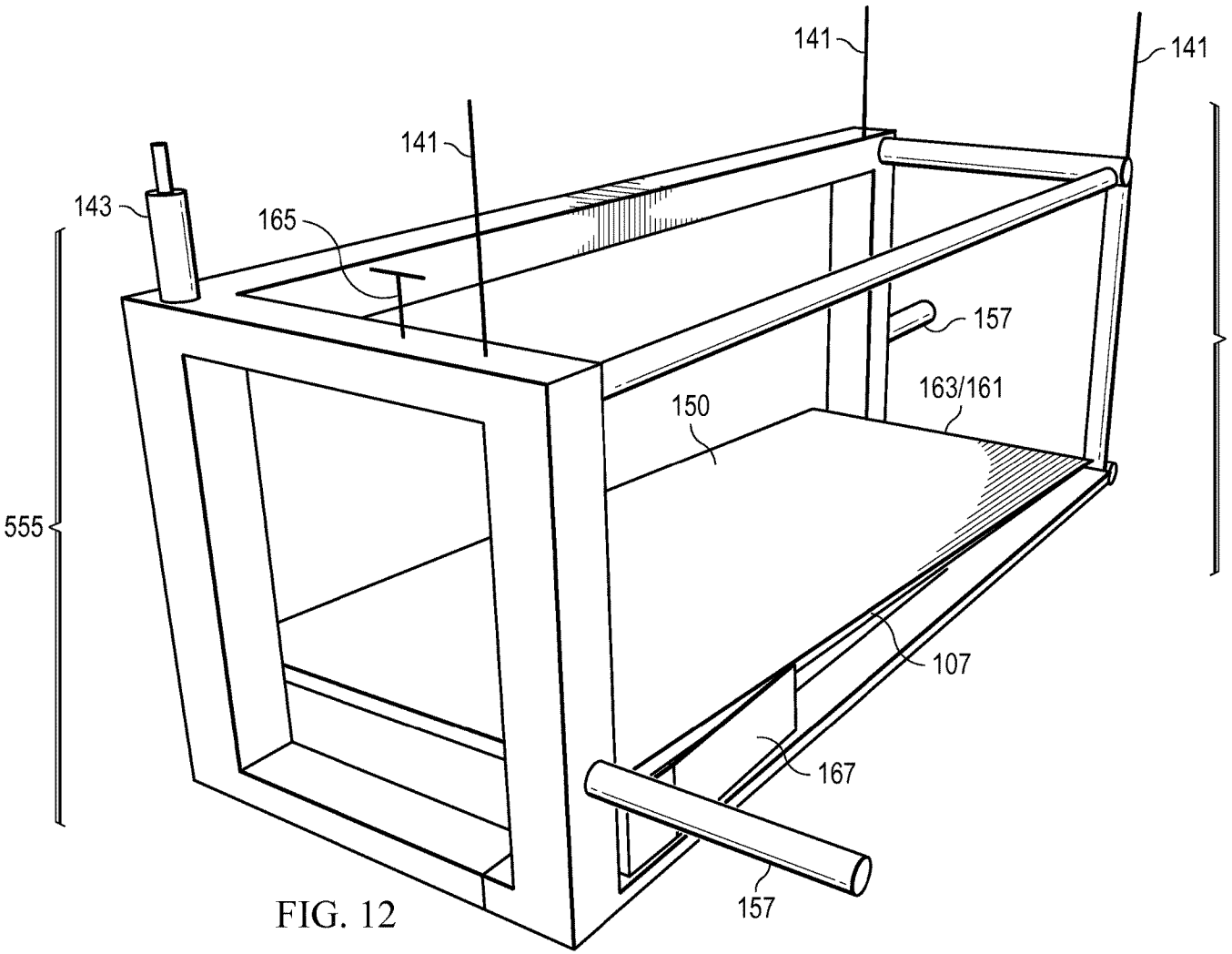
FIG. 12 illustrates a perspective view of the frame of the trash container of the present technology, according to an example embodiment.

FIG. 12 illustrates a perspective view of a frame 109 of an exemplary trash container 555. The frame 109 may include an inclined bottom wall 107, a multitude of tied down straps 141, an inflator/deflator device 143 and a multitude of release valves 157.

Additionally, FIG. 12 illustrates a support member 167 which may be a rectangle to support the bottom wall 107 and support the inclined aspect of the inclined bottom wall 107. FIG. 12 illustrates a cleat 165 to attach to a dog leash. The support member 167 may be inflatable in order to support a pet. FIG. 12 additionally illustrates a mat 150 which may be absorbing or non-absorbing to prevent liquids and or solid waste material from escaping from the frame 109 on to the support surface.

FIG. 12 illustrates a support system 167 which may be mounted under the bottom wall 107 and may be positioned within the cavity 000.

Figure 13:
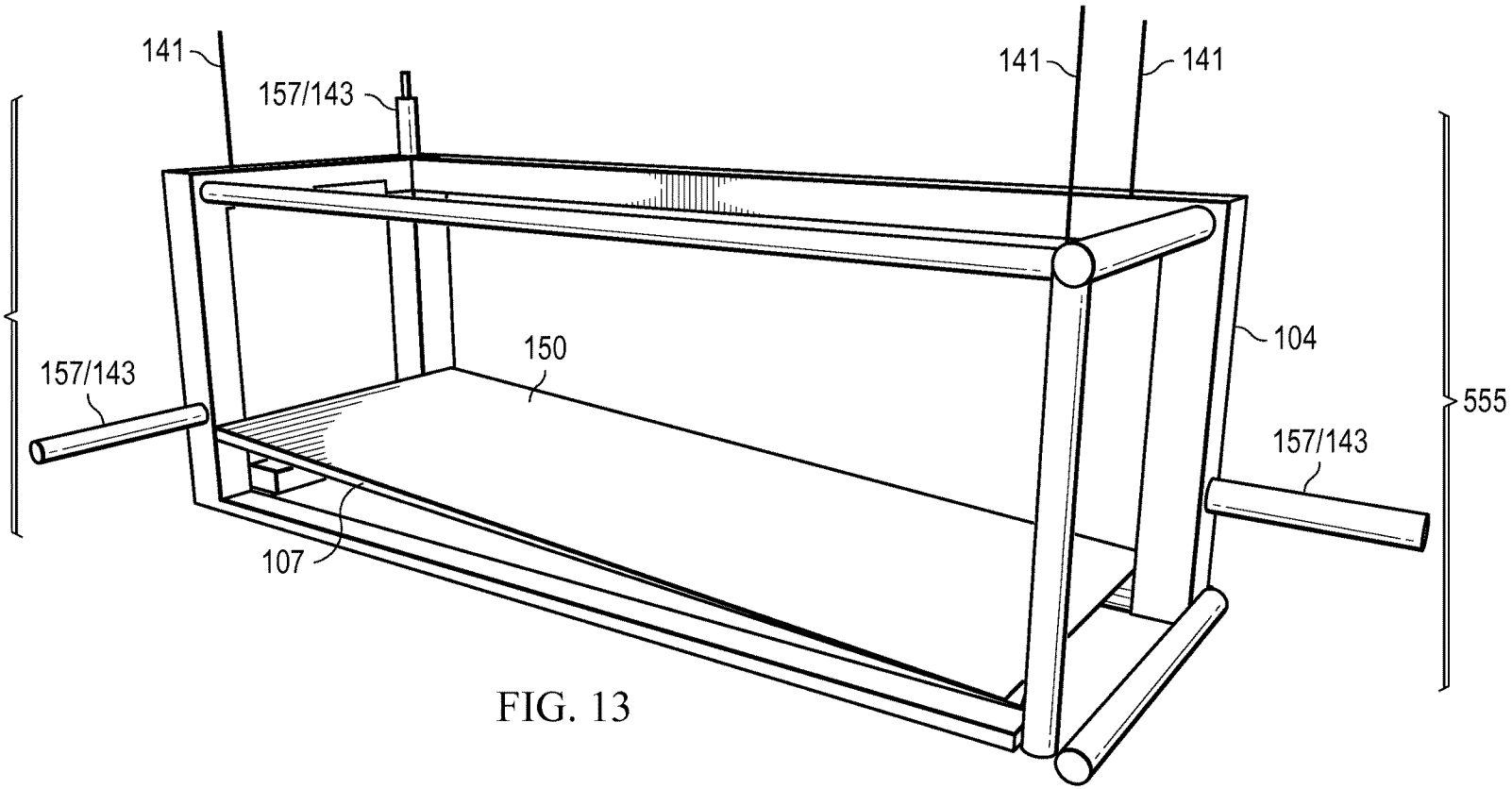
FIG. 13 illustrates a perspective view of the frame of the trash container of the present technology, according to an example embodiment.

FIG. 13 illustrates a perspective view of a frame 104 of an exemplary trash container 555. The frame 104 may include an inclined bottom wall 107, a multitude of tied down straps 141, an inflator/deflator device 143 and a release valve 157.

Figure 14:
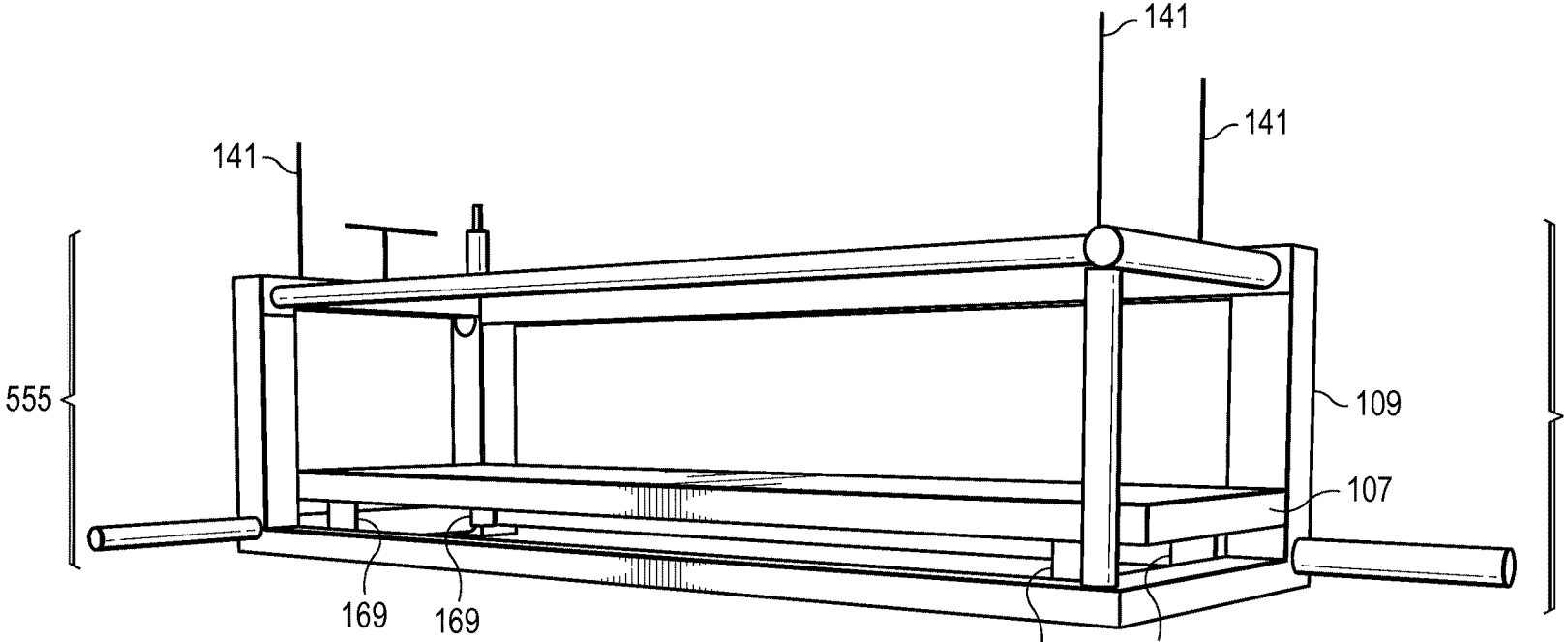
FIG. 14 illustrates a perspective view of the frame of the trash container of the present technology, according to an example embodiment.

FIG. 14 illustrates a perspective view of a frame 109 of an exemplary trash container 555. The frame 109 may include a bottom wall 107 which may be supported by a multitude of floor supports 169 (inflatable support surface), a multitude of tied down straps 141, an inflator/deflator device 143 and a multitude of release valves 157. FIG. 14 illustrates a cleat 165 to attach to a dog leash.

Figure 15:
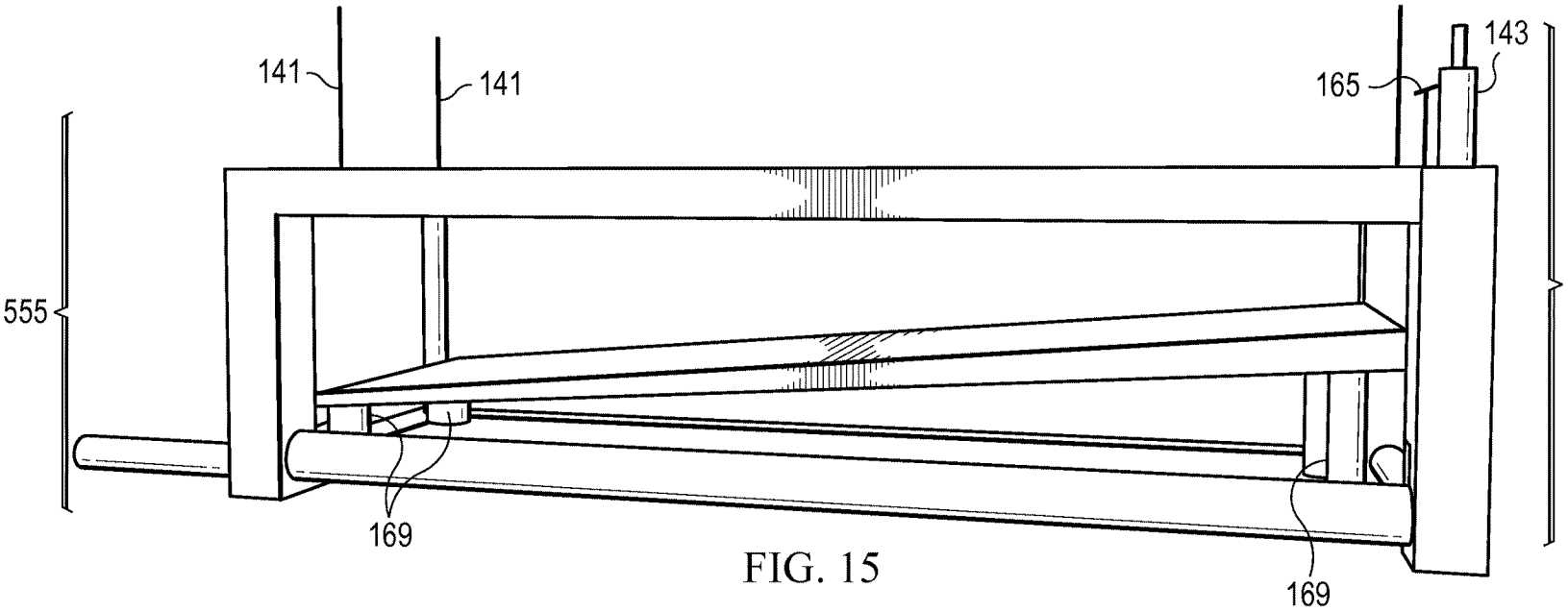
FIG. 15 illustrates a perspective view of the frame of the trash container of the present technology, according to an example embodiment.

FIG. 15 illustrates a perspective view of a frame 109 of an exemplary trash container 555. The frame 109 may include an inclined bottom wall 107 which may be supported by a multitude of floor supports 169 (inflatable support surface), a multitude of tied down straps 141, an inflator/deflator device 143 and a release valve 157.

Figure 16:
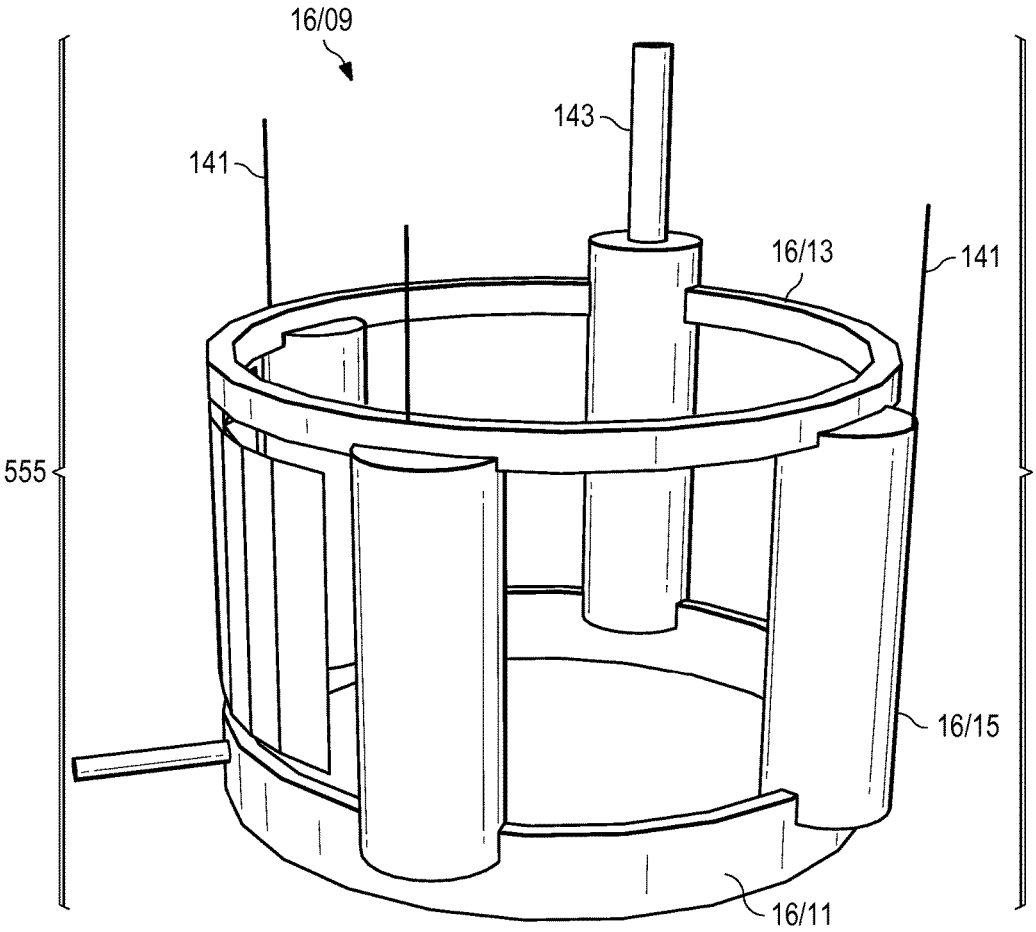
FIG. 16 illustrates a perspective view of another embodiment of the frame of the trash container of the present technology, according to an example embodiment.

FIG. 16 shows a bottom periphery member 16/11 of an exemplary trash container 555. The bottom periphery member 16/11 may be formed in a substantial ring, the top periphery member 16/13 which may be formed in a substantial ring and the vertical member 16/15 being a cylinder having a circular cross-section.

FIG. 16 additionally illustrates tied down straps 141 to be used to tie down the trash container 100, and FIG. 16 illustrates an inflation/deflation device 143 to allow the frame 16/09 to be inflated or deflated which may include an adjustable valve to seal and unseal the frame 109.

Figure 17:
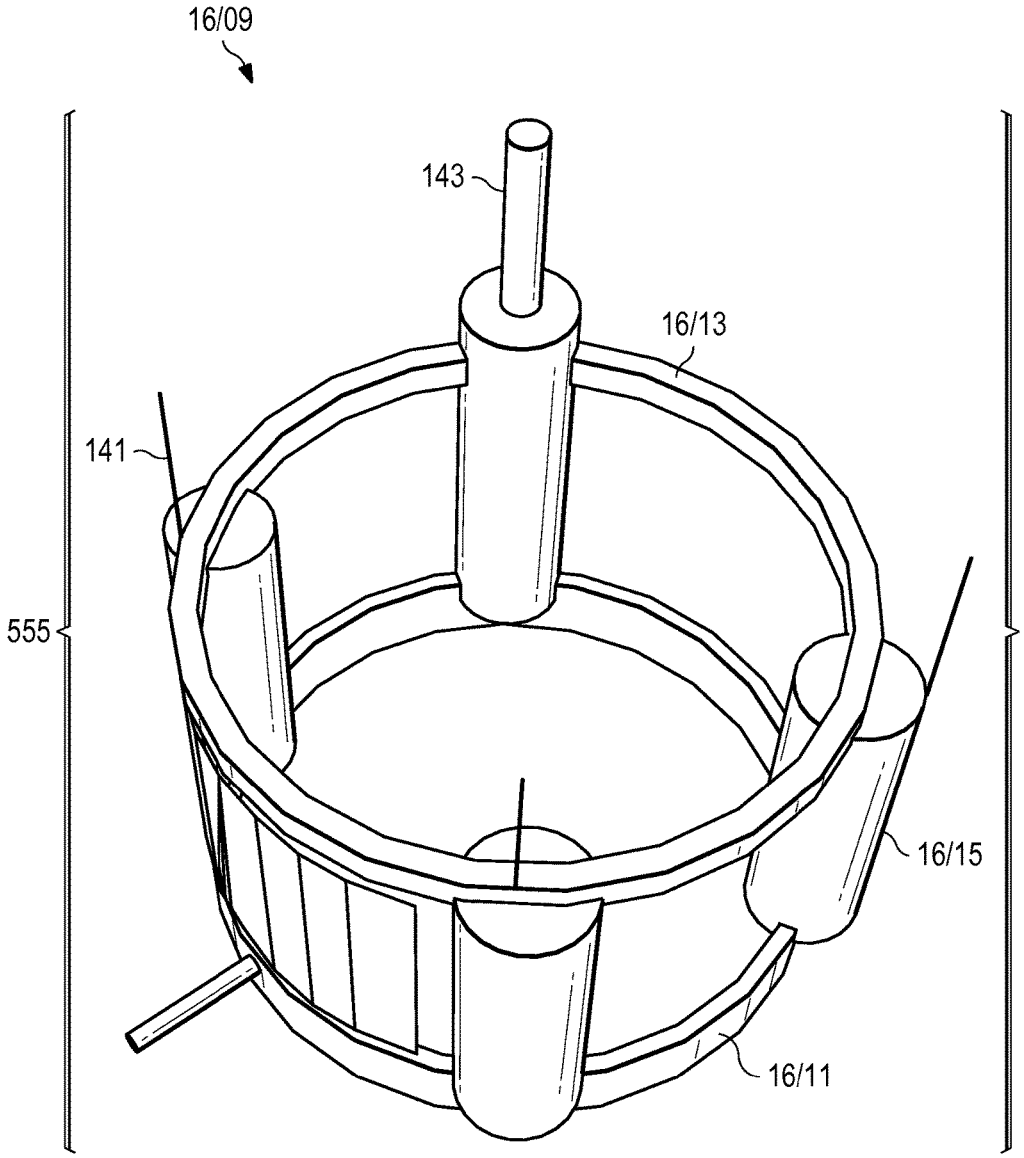
FIG. 17 illustrates a perspective view of another embodiment of the frame of the trash container of the present technology, according to an example embodiment.

FIG. 17 shows the bottom periphery member 16/11 of an exemplary trash container 555. The bottom periphery member 16/11 may be formed in a substantial ring, the top periphery member 16/13 which may be formed in a substantial ring and the vertical member 16/15 being a cylinder having a circular cross-section.

Figure 18:
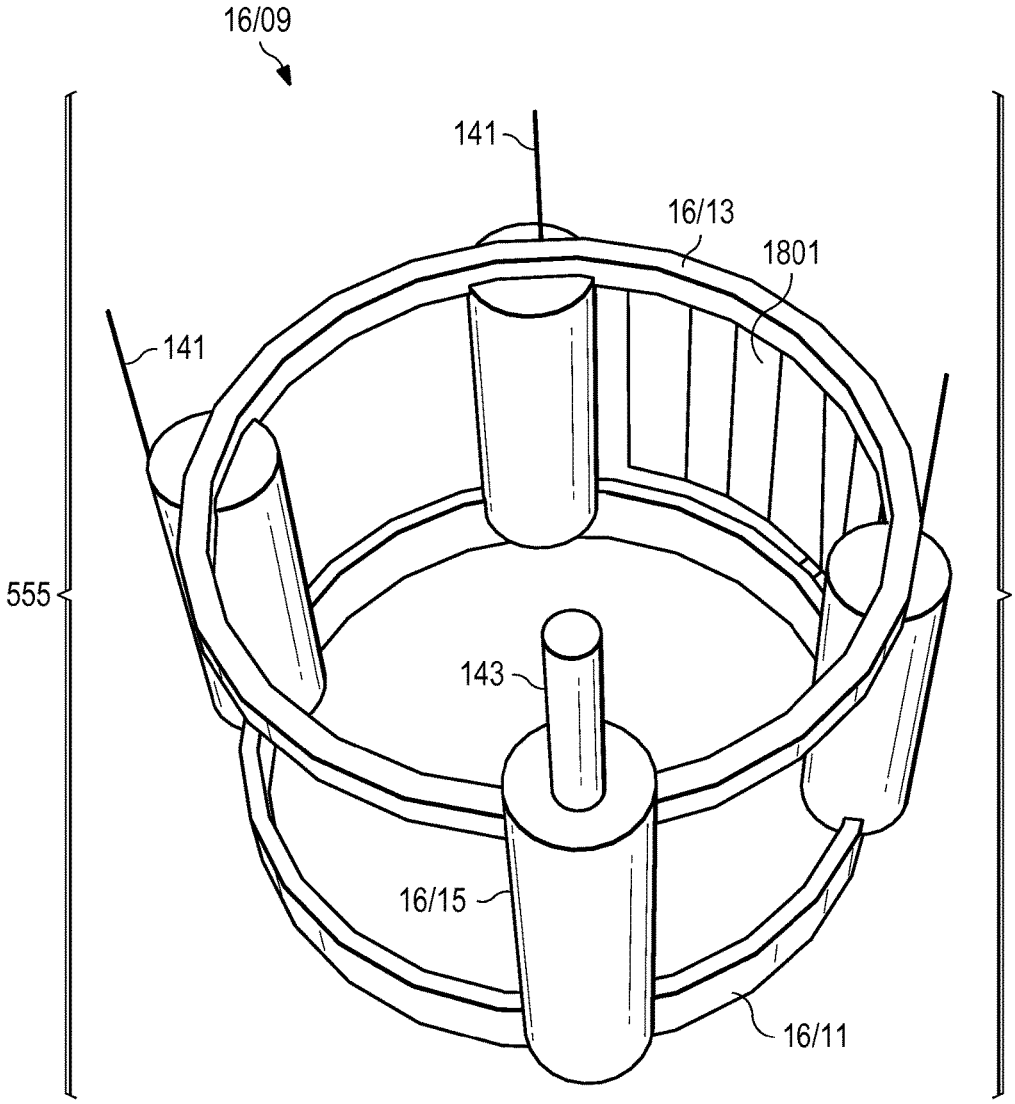
FIG. 18 illustrates a perspective view of another embodiment of the frame of the trash container of the present technology, according to an example embodiment.

FIG. 17 additionally illustrates tied down straps 141 to be used to tie down the trash container 100, and FIG. 18 illustrates an inflation/deflation device 143 to allow the frame 16/09 to be inflated or deflated which may include an adjustable valve to seal and unseal the frame 109.

FIG. 18 shows a bottom periphery member 16/11 of an exemplary trash container 555. The bottom periphery member 16/11 may be formed in a substantial ring, the top periphery member 16/13 which may be formed in a substantial ring and the vertical member 16/15 being a cylinder having a circular cross-section.

FIG. 18 additionally illustrates tied down straps 141 to be used to tie down the trash container 100, and FIG. 18 illustrates an inflation/deflation device 143 to allow the frame 16/09 to be inflated or deflated which may include an adjustable valve to seal and unseal the frame 109. FIG. 18 illustrates a portion of the sidewall 1801 which may extend around the periphery of the frame 16/09.

Figure 19:
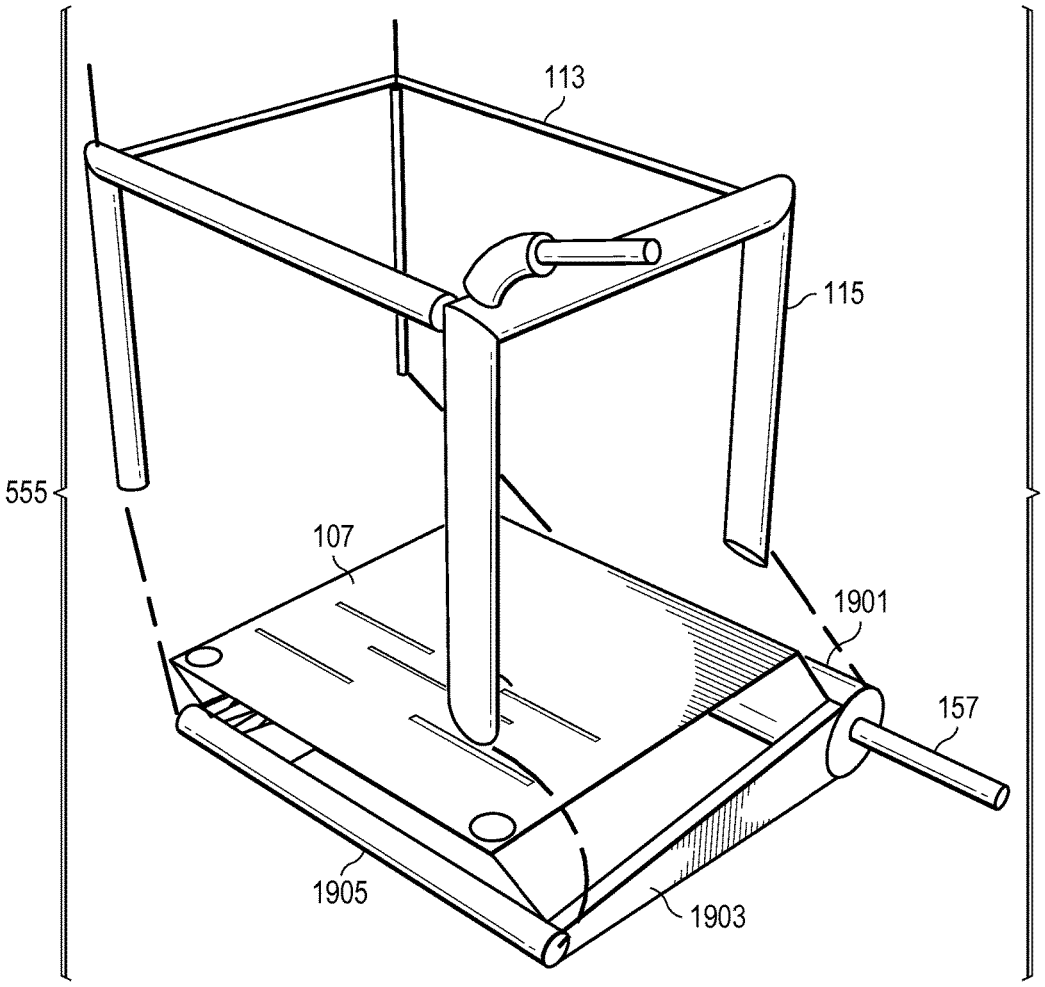
FIG. 19 illustrates an exploded view of the frame of the trash container of the present technology, according to an example embodiment.

FIG. 19 illustrates a base member 1901 of an exemplary trash container 555. The base member 1901 may include a back cylinder support 1902 a pair of opposing side walls 1903 which may be inclined and extend from the back cylinder support 1902 to the front wall 1905. The end of the base member 1901 may include a release valve 157, and the base member 1901 may support the bottom wall 107 as illustrated in FIG. 9. The base member 1901 may be connected to the vertical member 115 so that the base member 101, the vertical member 115 and the top periphery member 113 may be inflated/deflated simultaneously.

Figure 20:
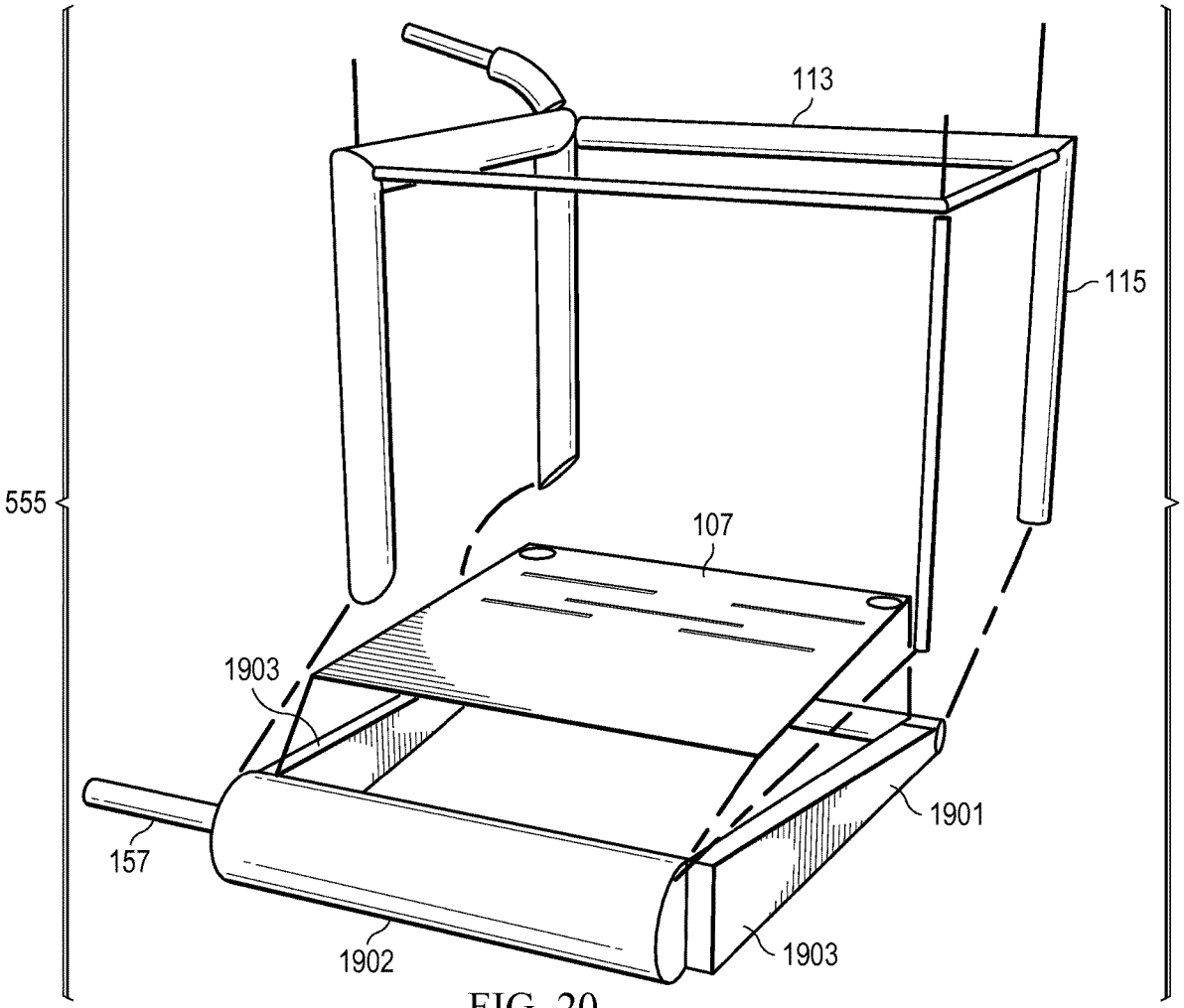
FIG. 20 illustrates an exploded view of the frame of the trash container of the present technology, according to an example embodiment.

FIG. 20 illustrates a base member 1901 of an exemplary trash container 555. The base member 1901 may include a back cylinder support 1902 a pair of opposing side walls 1903 which may be inclined and extend from the back cylinder support 1902 to the front wall 1905 (not shown). The end of the base member 1901 may include a release valve 157, and the base member 1901 may support the bottom wall 107 as illustrated in FIG. 9. The base member 1901 may be connected to the vertical member 115 so that the base member 101, the vertical member 115 and the top periphery member 113 may be inflated/deflated simultaneously.

Figure 21:
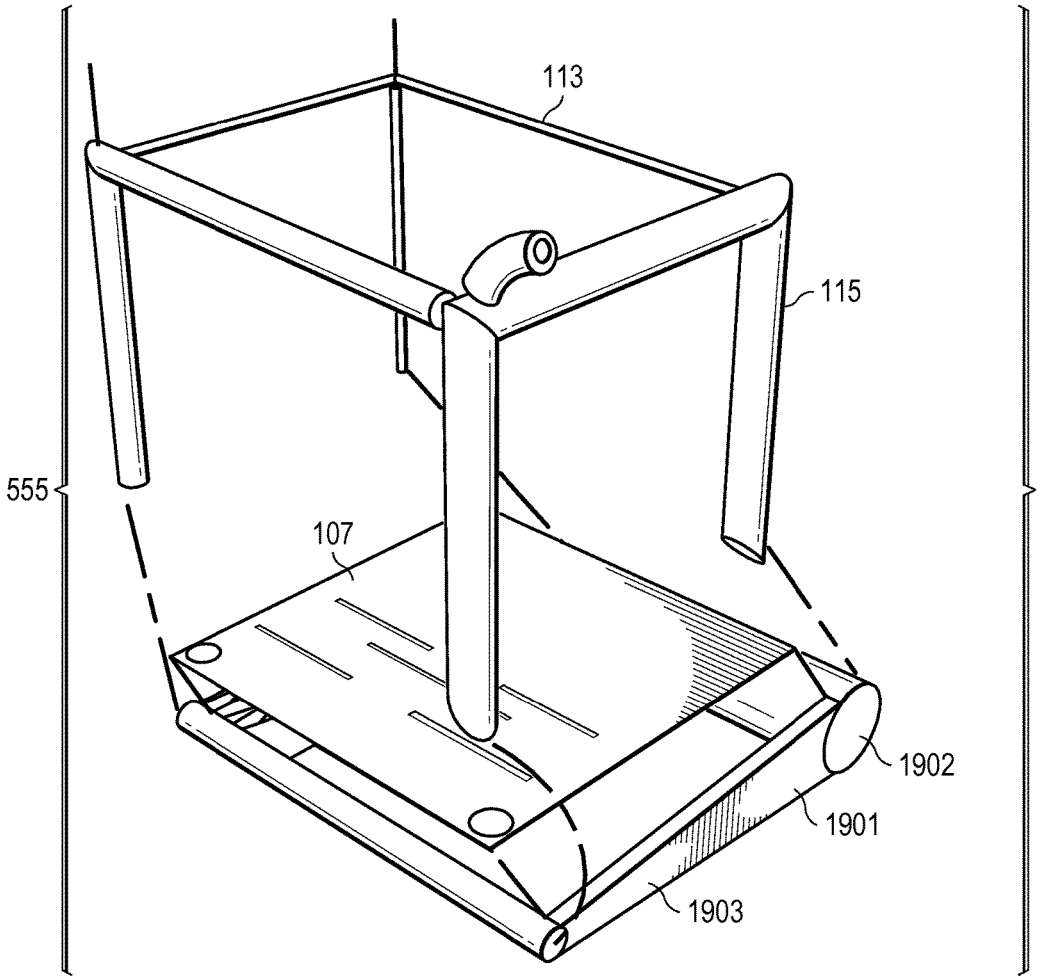
FIG. 21 illustrates an exploded view of the frame of the trash container of the present technology, according to an example embodiment.

FIG. 21 illustrates a base member 1901 of an exemplary trash container 555. The base member 1901 may include a back cylinder support 1902, a pair of opposing side walls 1903 which may be inclined and extend from the back cylinder support 1902 to the front wall 1905. The end of the base member 1901 may include a release valve 157, and the base member 1901 may support the bottom wall 107 as illustrated in FIG. 9. The base member 1901 may be connected to the vertical member 115 so that the base member 101, the vertical member 115 and the top periphery member 113 may be inflated/deflated simultaneously.

Figure 22:
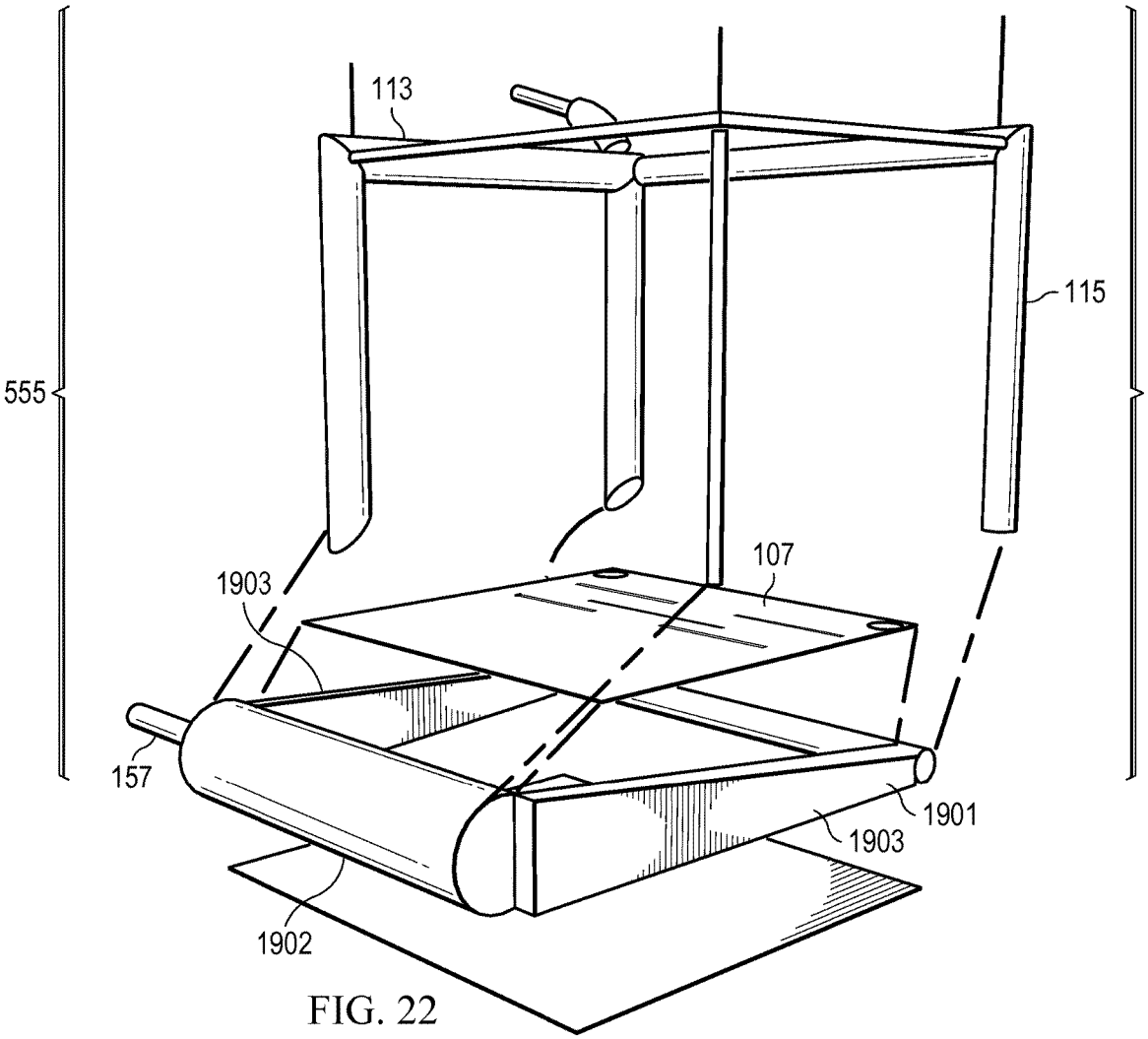
FIG. 22 illustrates an exploded view of the frame of the trash container of the present technology, according to an example embodiment.

FIG. 22 illustrates a base member 1901 of an exemplary trash container 555. The base member 1901 may include a back cylinder support 1902 or any other shape, a pair of opposing side walls 1903 which may be inclined and extend from the back cylinder support 1902 to the front wall 1905. The end of the base member 1901 may include a release valve 157, and the base member 1902, may support the bottom wall 107 as illustrated in FIG. 9. The base member 1901 may be connected to the vertical member 115 so that the base member 101, the vertical member 115 and the top periphery member 113 may be inflated/deflated simultaneously.

Figure 23:
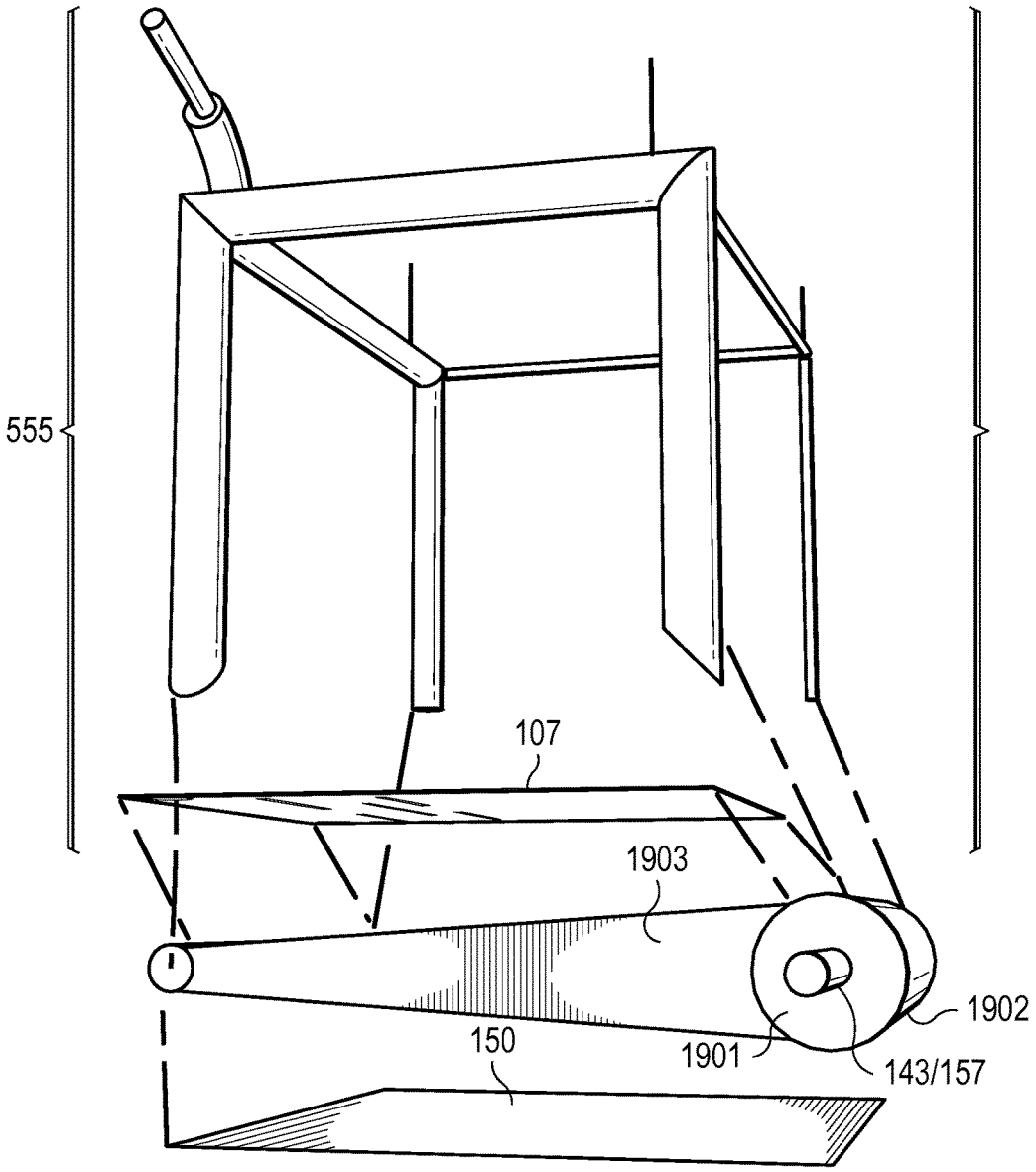
FIG. 23 illustrates an exploded view of the frame of the trash container of the present technology, according to an example embodiment.

FIG. 23 illustrates a base member 1901 of an exemplary trash container 555. The base member 1901 may include a back cylinder support 1902, a pair of opposing side walls 1903 which may be inclined and extend from the back cylinder support 1901 to the front wall 1905. The end of the base member 1901 may include a release valve 157, and the base member 1901 may support the bottom wall 107 as illustrated in FIG. 9. The base member 1901 may be connected to the vertical member 115 so that the base member 101, the vertical member 115 and the top periphery member 113 may be inflated/deflated simultaneously.

Figure 24:
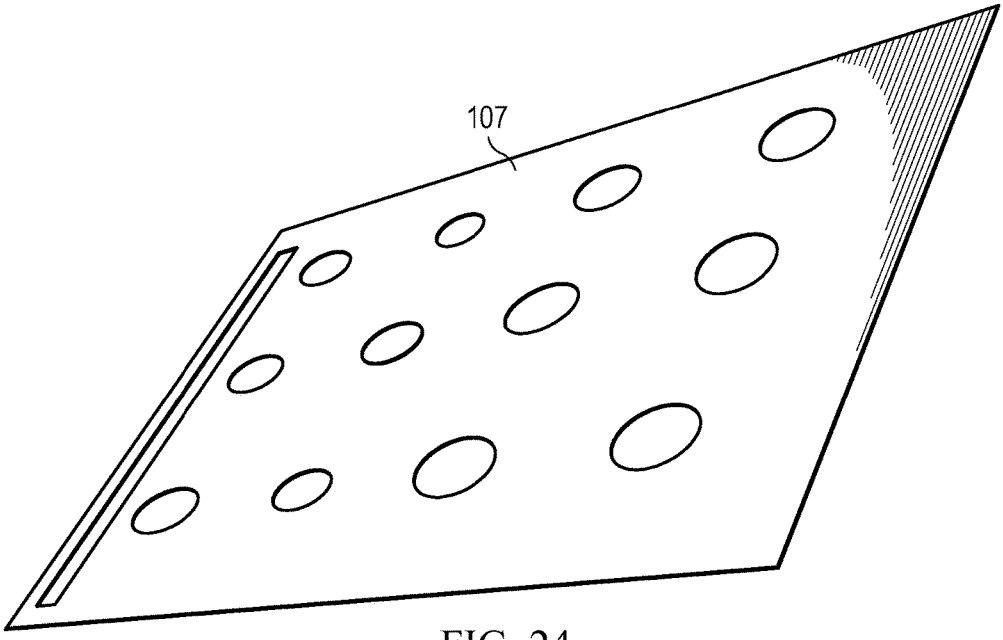
FIG. 24 illustrates a view of the bottom wall of the trash container of the present technology, according to an example embodiment.

FIG. 24 illustrates the bottom wall 107 having a multitude of apertures and a slot.

Figure 25:
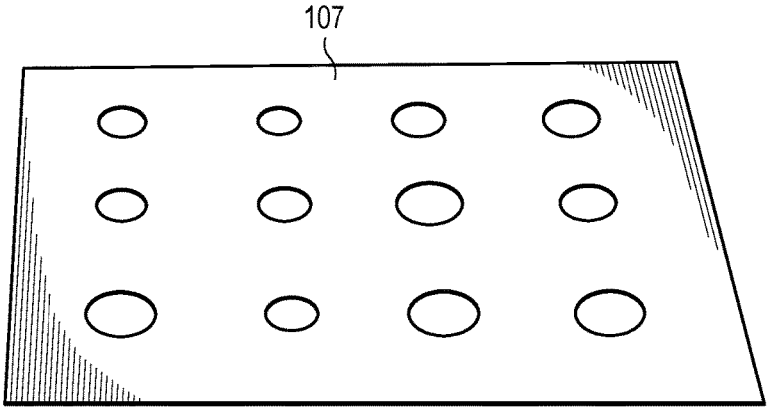
FIG. 25 illustrates a view of the bottom wall of the present technology, according to an example embodiment.

FIG. 25 illustrates the bottom wall 107 having a multitude of apertures.

Figure 26:
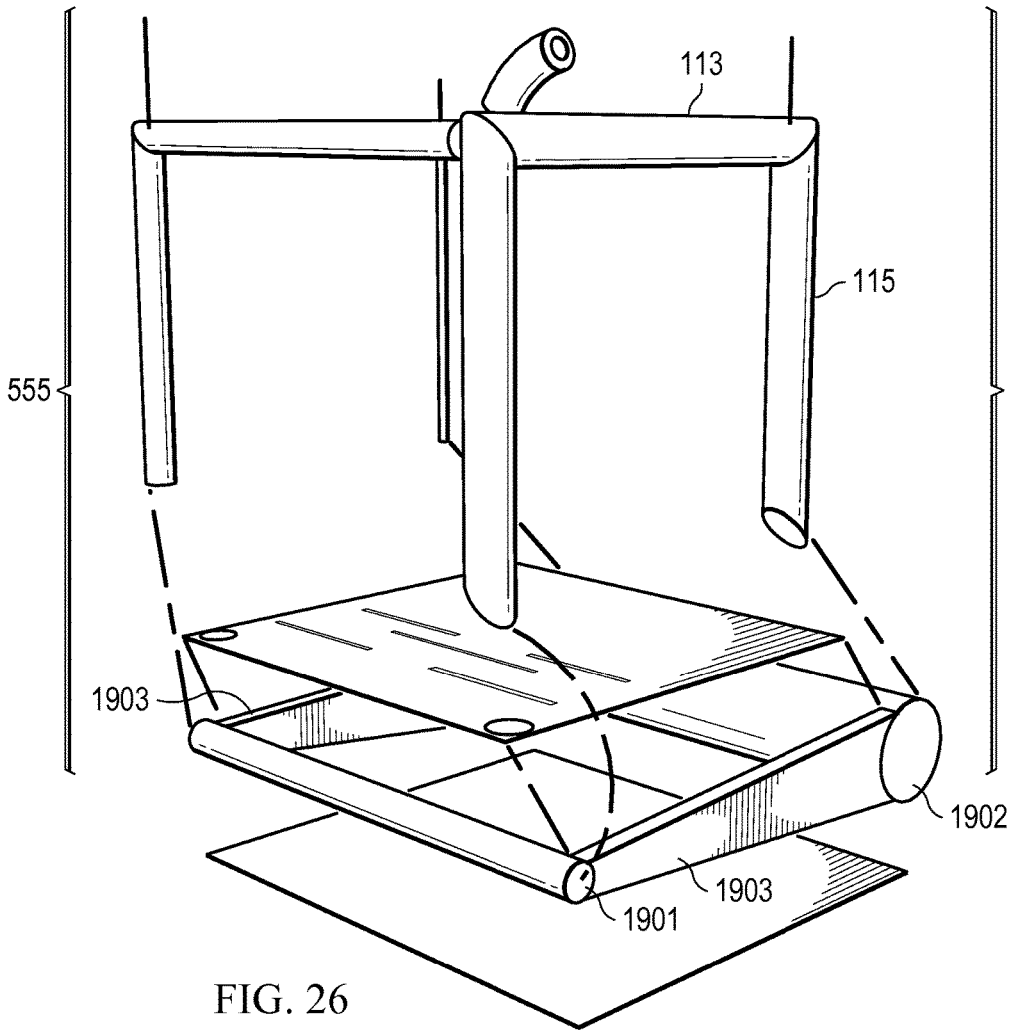
FIG. 26 illustrates an exploded view of the frame of the present technology, according to an example embodiment.

FIG. 26 illustrates a base member 1901 of an exemplary trash container 555. The base member 1901 may include a back cylinder support 1902, a pair of opposing side walls 1903 which may be inclined and extend from the back cylinder support 1902 to the front wall 1905. The end of the base member 1901 may include a release valve 157, and the base member 1901 may support the bottom wall 107 as illustrated in FIG. 9. The base member 1901 may be connected to the vertical member 115 so that the base member 101, the vertical member 115 and the top periphery member 113 may be inflated/deflated simultaneously.

Figure 27:
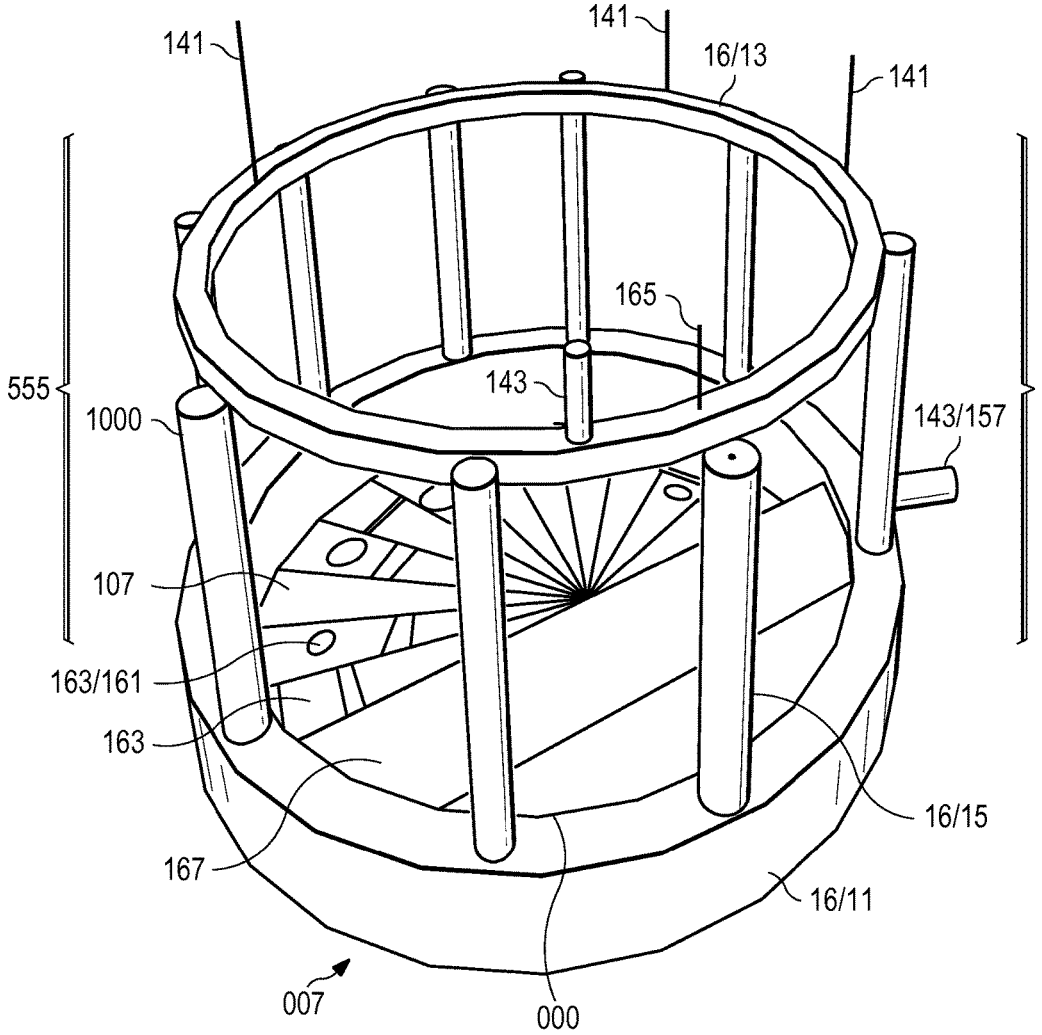
FIG. 27 illustrates an exploded view of the frame of the present technology, according to an example embodiment.

FIG. 27 shows a periphery member 16/11 of an exemplary trash container 555. The periphery member 16/11 may be formed in a substantial ring of any geometric shape. The top periphery member 16/13 which may be formed in a substantial ring of any shape or size and the vertical member 16/15 could be a cylinder having a circular cross-section or could be in geometrical shape.

FIG. 27 additionally illustrates tied down straps 141 to be used to tie down the trash container for easy disposal, and FIG. 27 illustrates an inflation/deflation device 143 to allow the frame 1000 to be inflated or deflated which may include an adjustable valve to seal and unseal the frame 1000.

FIG. 27 makes a point of showing a support area 167 which may or may not be inflated with frame 1000, declining down to a flexible or rigid support 107 declining possibly at a 1 degree angle to 90 degrees in relationship to the lowest floor to support area 007, and additionally holes or slits 163/161 will catch liquids or solids trapped between 107 and 007. Additionally, supports 107 and 007 may or may not have a liquid absorption material.

Figure 28:
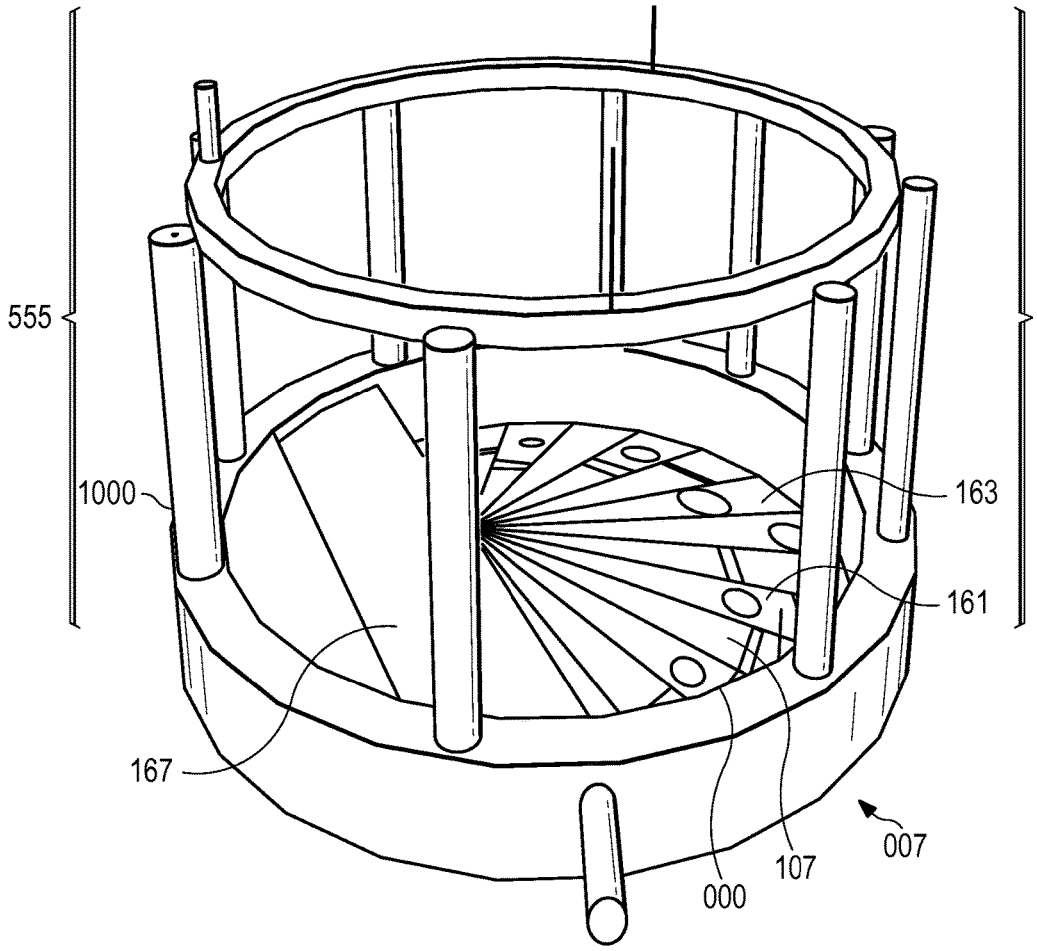
FIG. 28 illustrates a perspective view of the frame of the present technology, according to an example embodiment.

FIG. 28 illustrates the process of a liquid or solid being drained to 163 and 161 holes and slits 167 is the support area of an exemplary trash container 555. The support area may or may not be inflated with the frame 1000, the liquids can easily be transformed to support 107, and trapped between 107 and 007, with possible liquid or solid absorption device.

Figure 29:
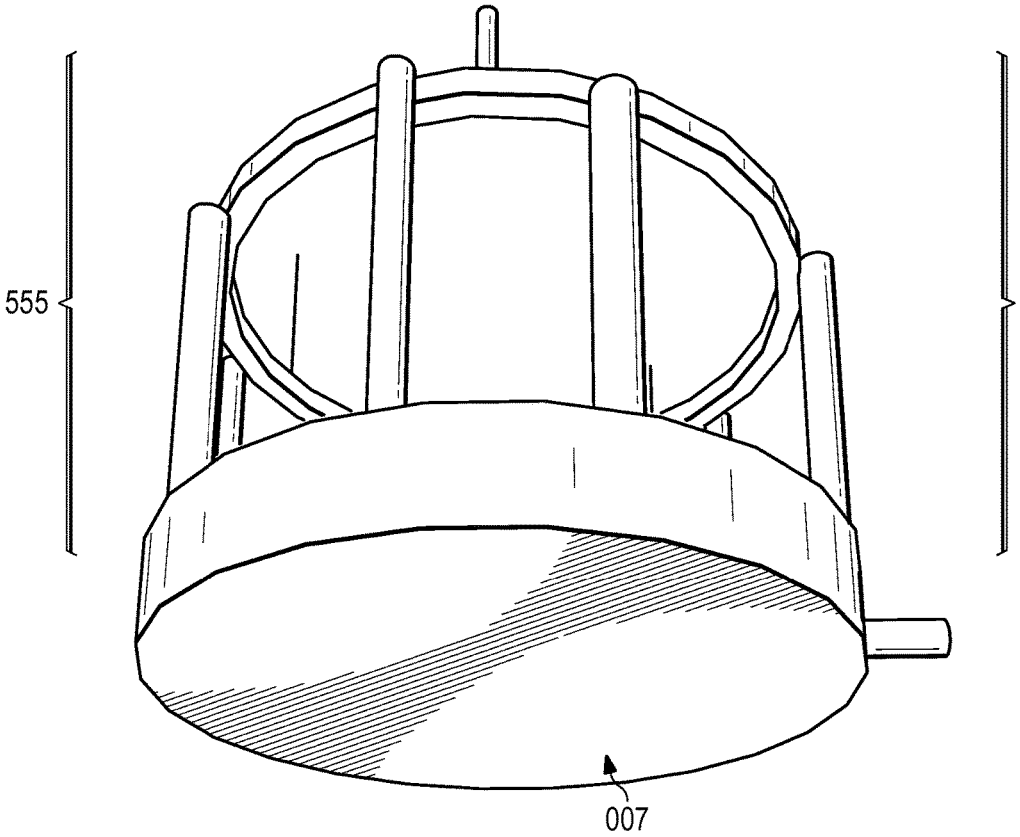
FIG. 29 illustrates a perspective view of the frame of the present technology, according to an example embodiment.

FIG. 29 illustrates the support 007 of an exemplary trash container 555, in which liquids and solids are trapped above 007 and below 107.

Figure 30:
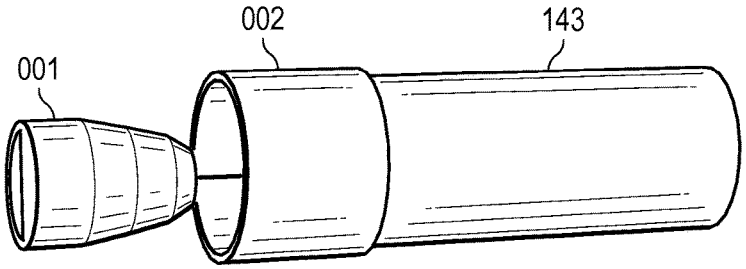
FIG. 30 illustrates a perspective view of the blow tube of the present technology, according to an example embodiment.

FIG. 30 shows a plug 001 and the blow tube 143 with end 002 which may or may not be rigid to allow for better air flow. A CO2 or automatic electric air machine or other liquid or air devices may be used.

Figure 12A:
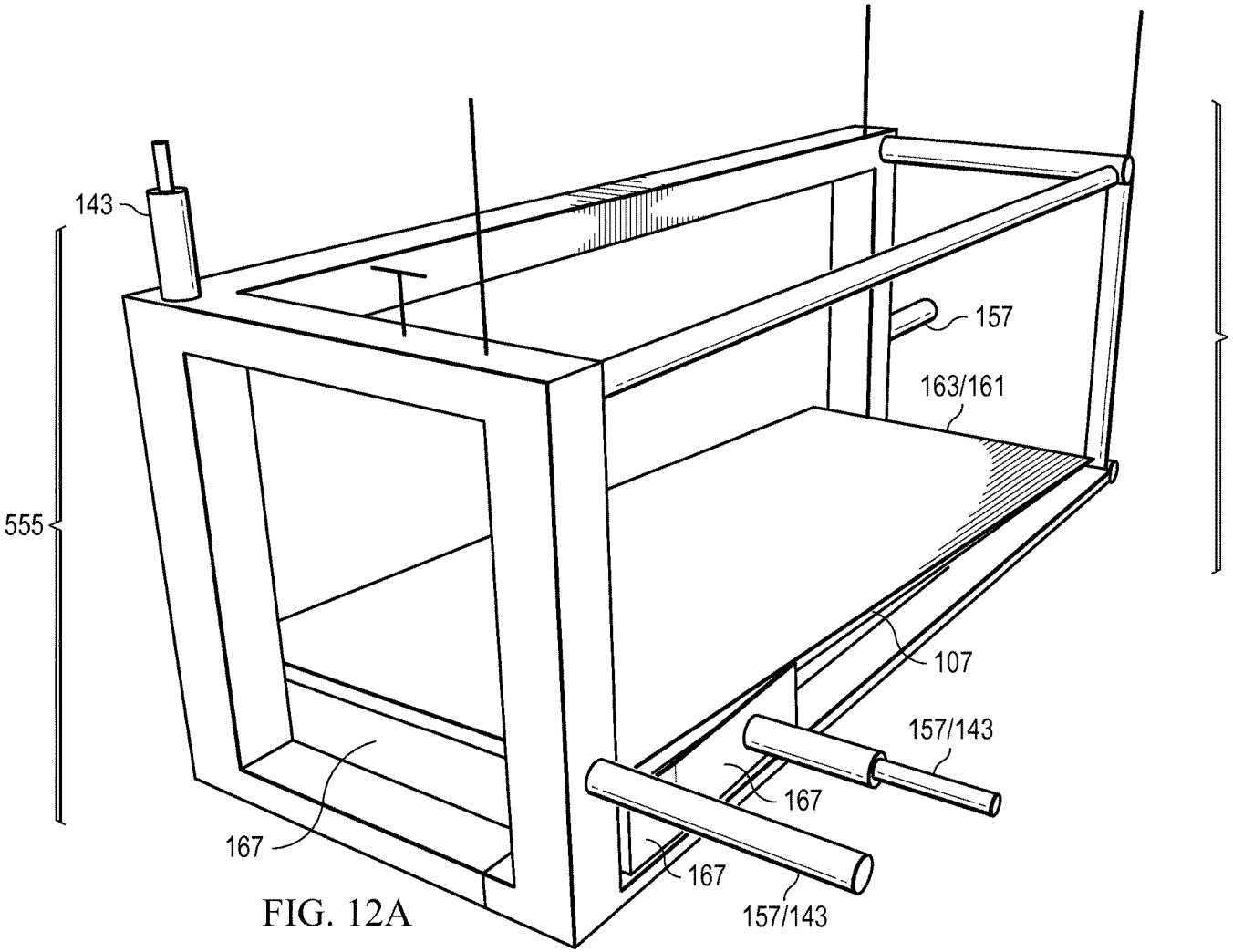
FIG. 12A illustrates a perspective view of the frame of the trash container of the present technology, according to an example embodiment.

FIG. 12A illustrates 167 a support system of an exemplary trash container 555. The support system may or may not be inflated by tubes 157/143.

FIG. 11A illustrates an absorption system that might be located in space, under rigid or non-rigid 107.

Figure 13A:
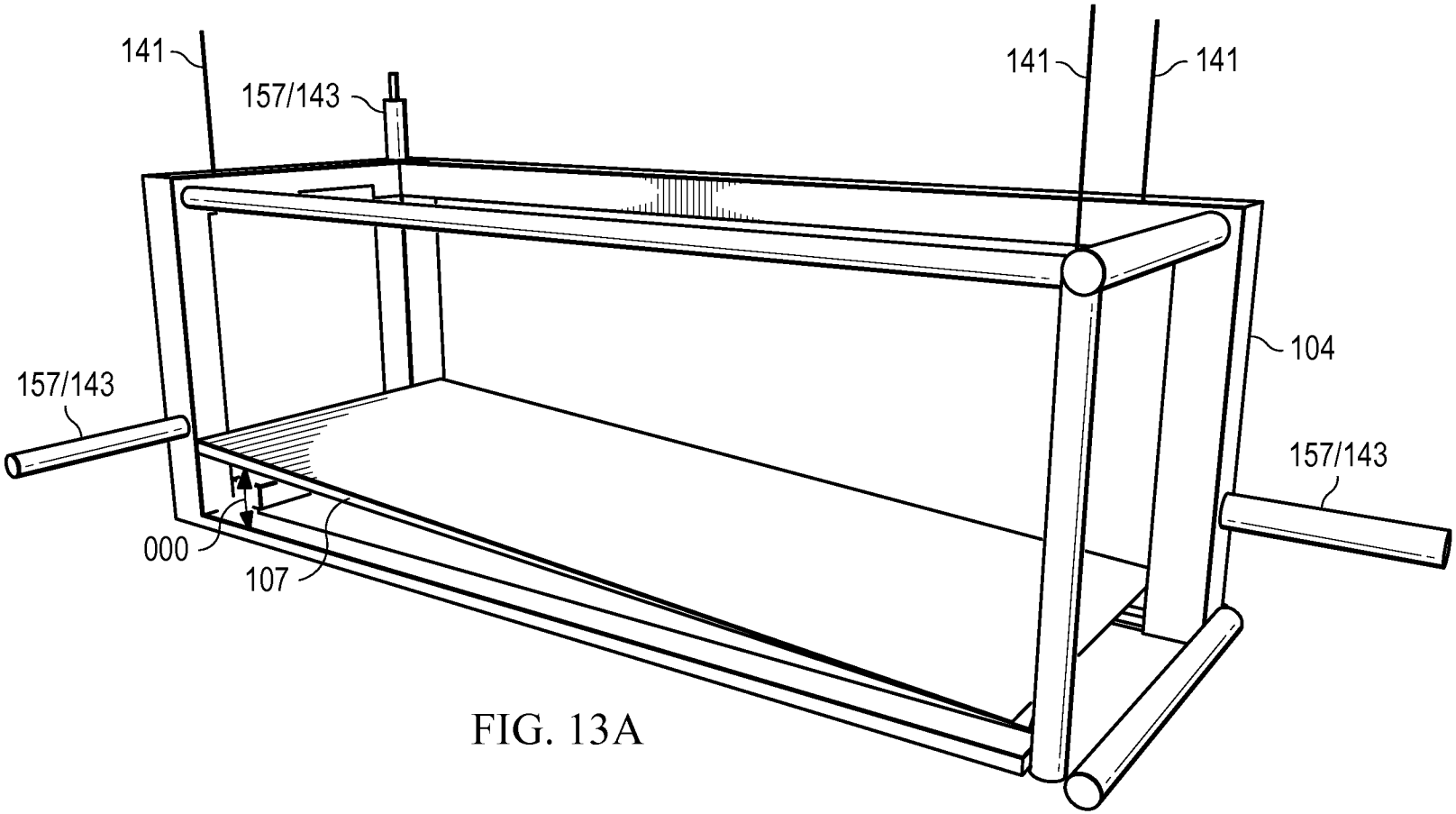
FIG. 13A illustrates a perspective view of the frame of the present technology, according to an example embodiment.

FIG. 13A show another angle of 000 in relation to 107 of frame 104.

Figure 31:
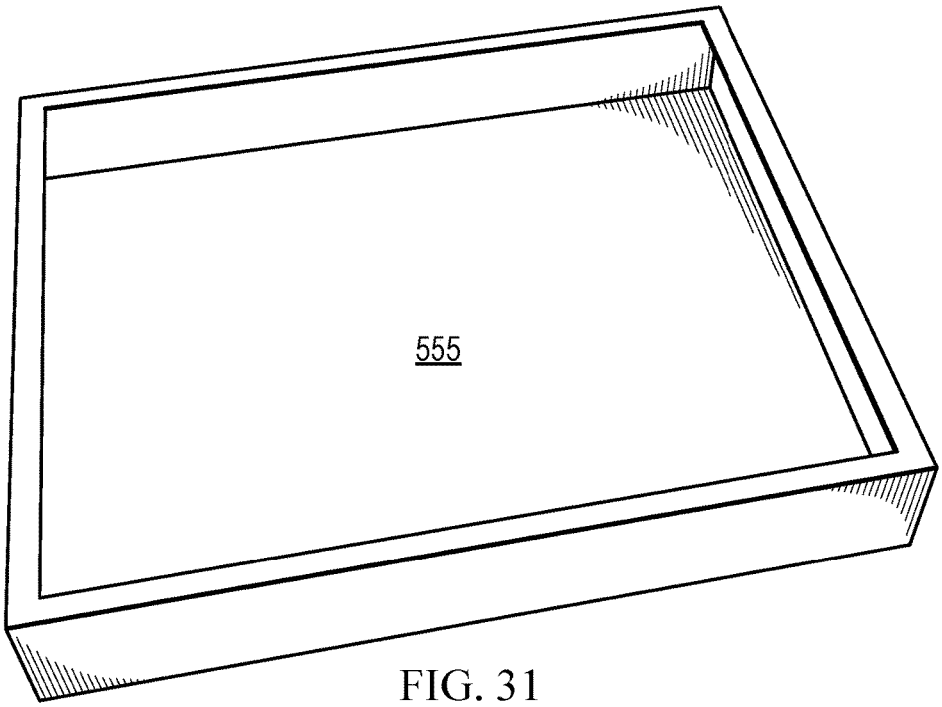
FIG. 31 illustrates another embodiment of the present technology, according to an example embodiment.

FIG. 31 illustrates the sheathing or outer covering of plastic or any other type of material of an exemplary trash container 555 that will serve as a skin to hold trash.

Figure 32:
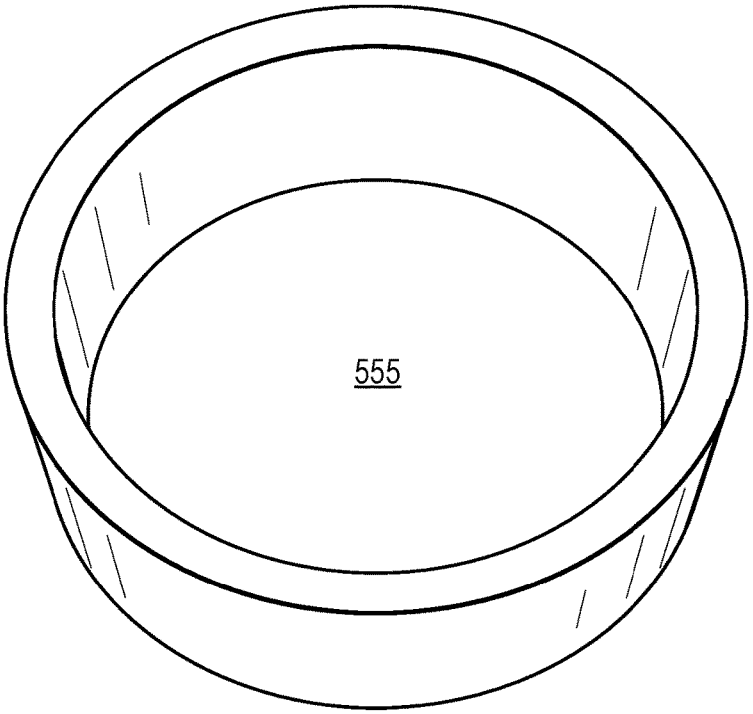
FIG. 32 illustrates another embodiment of the present technology, according to an example embodiment.

FIG. 32 is similar to the exemplary trash container 555 of FIG. 31, but FIG. 32 illustrates different shapes like circle, oval, or other geometric shape.

FIG. 3 is missing the sheathing that goes around the blow up tubes to hold trash in place. Looking at FIGS. 1 and 2, the sheathing is in place. The opposing walls 105 and the walls 101 and 103 and the bottom wall 107. The sheathing was left off on purpose to show the inside of device without walls blocking the blow tubes.

In some embodiments, FIGS. 5-27 are the same as FIG. 3 for sheathing.

FIG. 16 should have a different sheathing that is round and a bottom sheathing to hold in cavity.

FIG. 17 should have a different sheathing that is round and a bottom sheathing to hold waste in cavity.

FIG. 18 should have a different sheathing that is round and a bottom sheathing to hold waste in cavity.

Referring back to FIGS. 1 and 2 collectively, a trash container 100 is illustrated that comprises an inflatable frame. Generally, the inflatable frame 109 comprises a plurality of vertical inflatable, tubular vertical members (four of the substantially vertical members 115) extending normally from a bottom wall 107. For example, the plurality of vertical inflatable, tubular vertical members includes four top periphery members, such as top periphery member 113, which are arranged in a rectangular configuration. The inflatable frame 109 also comprises a plurality of bottom frame members. For example, four bottom periphery members, such as bottom periphery member 111 can be arranged into a rectangular configuration. The bottom periphery members 111 are associated with the bottom wall 107 in some embodiments, and can be coupled with the plurality of vertical inflatable, tubular vertical members. According to some embodiments, plurality of bottom frame members (four of the bottom periphery members 111) are inflatable.

Also, the plurality of upper frame members (four of the top periphery members 113) can also couple with the plurality of vertical inflatable, tubular vertical members 115. The plurality of upper frame members 113 are inflatable and arranged to form an opening of an enclosure. For example, the plurality of upper frame members 113 define the opening of the trash container 100.

In some embodiments, the plurality of vertical inflatable, tubular vertical members 115, plurality of bottom frame members 111, and plurality of upper frame members 113 are arranged to form openings. According to some embodiments, a plurality of flexible wall panels, such as wall panel 105 are associated with the openings to form the enclosure.

In some embodiments, the plurality of vertical inflatable, tubular vertical members 115, plurality of bottom frame members 111, and plurality of upper frame members 113 are interconnected together in fluid communication.

In one embodiment an inflation/deflation device 143 for inflating/deflating the inflatable frame is provided on one of the plurality of upper frame members 113. A second inflation/deflation device can be coupled with the plurality of bottom frame members 111 and/or one of the plurality of vertical inflatable, tubular vertical members 115.

According to some embodiments, a plurality of tie downs, such as tie down 141 are associated with the plurality of upper frame members, such as upper frame member 113. In some embodiments, the plurality of vertical inflatable, tubular vertical members 115, the plurality of bottom frame members 111, and the plurality of upper frame members 113 are interconnected together in fluid communication. Thus, the inflatable frame 109 can be inflated by using the inflation/deflation device 143, which is associated with one component of the inflatable frame 109.

As best illustrated in FIG. 4, the plurality of upper frame members 113 are connected to the plurality of vertical inflatable, tubular vertical members 115 at right angles using rectangular members, such as rectangular member 151.

Some embodiments can include a release valve (see release valve 157 of FIG. 3) associated with the plurality of bottom frame members 111.

According to some embodiments, the bottom wall 107 comprises a wedge member (illustrated in FIG. 9). Embodiments illustrating wedge members include FIGS. 10-15 and 19-23. In some embodiments, the wedge member comprises rows of slits 163 that permit passage of fluid from within the enclosure, outwardly. The rows of slits 163 are offset from one another in some embodiments.

In accordance with the present disclosure, the trash container 100 can include a mat 150 that extends across the bottom wall 107. The bottom wall 107 has triangular sidewalls that cooperate with a back sidewall, as well as the mat 150 to create an example wedge member. In some embodiments, the mat is absorbent and configured to absorb liquids.

As illustrated in FIGS. 10-15, the bottom wall 107 can be inclined relative to the ground and forms a cavity with the plurality of bottom frame members.

In some embodiments, one or more support plates, such as support plate 167 (see FIGS. 12 and 12A), extend between the plurality of bottom frame members and the inclined bottom wall 107. The one or more support plates are inflatable in some instances.

In additional embodiments, the bottom wall 107 is inclined and supported at opposing ends with inflatable floor supports, such as inflatable floor supports 169 illustrated in FIG. 15. These supports are disposed at the corners of the bottom wall 107, as an example configuration.

Some embodiments include cylindrical inflatable supports, such as in FIG. 26. In these embodiments, one of the plurality of bottom frame members, such as frame member 1902 can be enlarged to form a back cylinder support such that the bottom wall 1903 is inclined when coupled with the bottom frame members (1901 and 1902).

Some embodiments, such as trash containers of FIGS. 27-29 include inflatable cylindrical rings, such as a bottom periphery member 16/11 of FIG. 27. A plurality of vertical inflatable, tubular vertical members (such as 16/15) are coupled to the inflatable ring 16/11.

In some embodiments, an upper frame ring 16/13 is included and is also inflatable. The upper frame ring 16/13 forms an opening of an enclosure. Wall panels and an inflation/deflation device can be included as well. In some embodiments, the inflation/deflation device comprises an adjustable valve.

In some embodiments, a bottom wall has a support area and a plurality of pie wedge sections 107 that are angled downwardly away from the support area. A portion of the plurality of pie wedge sections can comprise slits or holes 163/161 for providing fluid communication from inside the enclosure.

The trash container can include a support area 007. The support area and the plurality of pie wedge sections are spaced apart from the lowest floor to form a space. In some embodiments, a liquid absorbing material is disposed in the space.

While the present technology is susceptible to various modifications and alternative forms, specific embodiments thereof have been shown by way of example in the drawings and are herein described in detail. It should be understood, however, that the description herein of specific embodiments is not intended to limit the technology to the particular forms disclosed.

What is claimed is:

1. A container, comprising:

an inflatable frame comprising:

a plurality of inflatable vertical members extending normally from a bottom wall;

a plurality of inflatable bottom frame members coupled with the bottom wall and associated with the plurality of inflatable vertical members;

a plurality of inflatable upper frame members associated with the plurality of inflatable vertical members; and the plurality of inflatable vertical members, the plurality of inflatable bottom frame members, and the plurality of inflatable upper frame members are arranged to form one or more openings; and an inflation/deflation device for inflating/deflating the inflatable frame.

2. The container according to claim 1, wherein the plurality of inflatable vertical members, the plurality of inflatable bottom frame members, and the plurality of inflatable upper frame members are interconnected together in fluid communication.

3. The container according to claim 1, wherein the bottom wall is inclined and supported at opposing ends with inflatable floor supports.

4. The container according to claim 3, wherein the plurality of inflatable vertical members, the plurality of inflatable bottom frame members, the plurality of inflatable upper frame members, and the inflatable floor supports are interconnected together in fluid communication.

5. The container according to claim 1, further comprising a plurality of flexible wall panels associated with the one or more openings to form an enclosure.

6. The container according to claim 1, further comprising one or more tie downs associated with the inflatable frame.

7. The container according to claim 1, wherein the plurality of inflatable upper frame members are associated with the plurality of inflatable vertical members at right angles using rectangular members.

8. The container according to claim 1, wherein the plurality of inflatable bottom frame members are connected to the plurality of inflatable vertical members at right angles using rectangular members.

9. The container according to claim 1, further comprising a second inflation/deflation device associated with the inflatable frame.

10. The container according to claim 9, wherein the second inflation/deflation device is a release valve.

11. The container according to claim 1, wherein the bottom wall comprises a wedge member, the wedge member comprising rows of slits for providing fluid communication from inside an enclosure formed by the plurality of inflatable vertical members, the plurality of inflatable bottom frame members, and the plurality of inflatable upper frame members.

12. The container according to claim 11, wherein the rows of slits are offset from one another.

13. The container according to claim 1, wherein the bottom wall is inclined and forms a cavity with the plurality of inflatable bottom frame members.

14. A container, comprising:

an inflatable frame comprising:

a plurality of inflatable vertical members extending normally from a bottom wall;

an inflatable bottom frame ring coupled with the bottom wall and associated with the plurality of inflatable vertical members;

an inflatable upper frame ring associated with the plurality of inflatable vertical members; and the plurality of inflatable vertical members, the inflatable bottom frame ring, and the inflatable upper frame ring are arranged to form one or more openings; and an inflation/deflation device for inflating/deflating the inflatable frame.

15. The container according to claim 14, wherein the plurality of inflatable vertical members, the inflatable bottom frame ring, and the inflatable upper frame ring are interconnected together in fluid communication.

16. The container according to claim 14, wherein the bottom wall is inclined and supported at opposing ends with inflatable floor supports.

17. The container according to claim 16, wherein the plurality of inflatable vertical members, the inflatable bottom frame ring, the inflatable upper frame ring, and the inflatable floor supports are interconnected together in fluid communication.

18. The container according to claim 14, further comprising a plurality of flexible wall panels associated with the one or more openings to form an enclosure.

19. The container according to claim 14, wherein the bottom wall is comprised of a support area and a plurality of pie wedge sections that are angled downwardly away from the support area.

20. The container according to claim 19, wherein at least a portion of the plurality of pie wedge sections comprises slits or holes for providing fluid communication from inside an enclosure formed by the plurality of inflatable vertical members, the inflatable bottom frame ring, and the inflatable upper frame ring.

* * * * *